US011566855B2

(12) United States Patent
Nitta

(10) Patent No.: US 11,566,855 B2
(45) Date of Patent: Jan. 31, 2023

(54) TUBE AND CHAMBER HEAT EXCHANGE APPARATUS HAVING A MEDIUM DIRECTING ASSEMBLY WITH ENHANCED MEDIUM DIRECTING PANELS

(71) Applicant: Takeyoshi Nitta, Upland, CA (US)

(72) Inventor: Takeyoshi Nitta, Upland, CA (US)

(73) Assignee: Mikutay Corporation, Ontario, CA (US)

( * ) Notice: Subject to any disclaimer, the term of this patent is extended or adjusted under 35 U.S.C. 154(b) by 745 days.

(21) Appl. No.: 16/536,577

(22) Filed: Aug. 9, 2019

(65) Prior Publication Data

US 2021/0041185 A1 Feb. 11, 2021

(51) Int. Cl.
*F28F 1/40* (2006.01)
*F28F 9/22* (2006.01)

(52) U.S. Cl.
CPC ..... *F28F 1/40* (2013.01); *F28F 2009/224* (2013.01); *F28F 2009/226* (2013.01)

(58) Field of Classification Search
CPC ..... F28F 1/04; F28F 1/045; F28F 1/40; F28F 9/22; F28F 2009/222; F28F 2009/228; F28F 2009/226
USPC ..... 138/38
See application file for complete search history.

(56) References Cited

U.S. PATENT DOCUMENTS 3,051,453 A * 8/1962 Sluijters ..... D01D 1/065 366/337
3,450,199 A * 6/1969 Warrell ..... F28F 13/02 165/DIG. 415
3,525,391 A * 8/1970 Day ..... F28D 9/0031 261/112.1
4,497,751 A * 2/1985 Pluss ..... F28F 25/08 428/116
5,040,596 A * 8/1991 Terasaki ..... F28D 9/0062 165/185
5,522,661 A * 6/1996 Tsukada ..... B01F 25/43151 366/337
5,758,967 A * 6/1998 King ..... F15D 1/065 366/337
7,040,802 B2 * 5/2006 Fuglister ..... B29C 48/362 366/337
8,393,782 B2 * 3/2013 Smith ..... B01F 25/31331 366/337
10,202,880 B2 * 2/2019 Kuroyanagi ..... F28D 7/1684
(Continued)

*Primary Examiner* — Tho V Duong
*Assistant Examiner* — Raheena R Malik

(57) ABSTRACT

A heat exchanger with a chamber assembly, having a medium directing assembly disposed within. The medium directing assembly provided with a first and a second medium directing panel member, each respectively a planar panel member having a first side and a second side. A heat exchange medium introduced into the chamber assembly in an initial line of flow is vertically diverted into two flows to impact the first side of the first and the second medium directing panel member separately. Each diverted heat exchange medium is then further diverted into a pair of divergent arcuate lateral flow, wherein each lateral flow is directed to impact the lateral sides of the chamber assembly. On the respective second sides of the first and the second medium directing panel member, laterally diverted heat exchange medium is directed to collide into each other, where the pair of laterally diverted flows are subsequently merged.

20 Claims, 5 Drawing Sheets

(56) References Cited

U.S. PATENT DOCUMENTS

| | | | | |
|---|---|---|---|---|
| 2005/0189095 | A1* | 9/2005 | Damsohn | F28F 1/04 165/148 |
| 2005/0219947 | A1* | 10/2005 | Carlson | B01F 25/4315 366/337 |
| 2006/0016582 | A1* | 1/2006 | Hashimoto | F28D 7/1684 165/109.1 |
| 2009/0223648 | A1* | 9/2009 | Martin | F28F 27/00 165/86 |
| 2011/0290466 | A1* | 12/2011 | Nitta | F28F 13/08 165/181 |
| 2012/0138278 | A1* | 6/2012 | Pacholski | F28D 7/10 165/157 |
| 2015/0114609 | A1* | 4/2015 | Wang | F28F 13/12 165/109.1 |
| 2015/0129184 | A1* | 5/2015 | Alhazmy | F28F 7/02 165/168 |
| 2016/0201944 | A1* | 7/2016 | Zhang | F28D 20/0034 122/18.31 |
| 2017/0284343 | A1* | 10/2017 | Nitta | F28D 1/06 |
| 2017/0307309 | A1* | 10/2017 | Negi | F28F 13/12 |
| 2018/0115031 | A1* | 4/2018 | Lee | H01M 10/625 |
| 2019/0085795 | A1* | 3/2019 | Nitta | F28D 7/1615 |

* cited by examiner

TUBE AND CHAMBER HEAT EXCHANGE APPARATUS HAVING A MEDIUM DIRECTING ASSEMBLY WITH ENHANCED MEDIUM DIRECTING PANELS

BACKGROUND OF THE INVENTION

The present invention relates to heat exchangers utilized to transport heat from one heat exchange medium to another, and more specifically related to a tube and chamber type heat exchange apparatus having a medium directing member disposed within a chamber assembly, utilizing the medium directing member to enhance the flow pattern of heat exchange medium for the desired effect.

DISCUSSION OF THE RELATED ART

In a typical tube and chamber type heat exchanger, a core body comprising a plurality of tube and chamber sections is provided wherein at least two heat exchange mediums are utilized to transfer heat between the two heat exchange mediums. A first heat exchange medium is generally fed inside the plurality of tube and chamber sections while a second heat exchange medium flows outside the plurality of tube and chamber sections. The chamber section is generally a hollow body, provided with a medium directing insert disposed within the chamber section to divert the flow of the first heat exchange medium in desired ways, generally resulting in two divergent semi-circular flow of the first heat exchange medium around the medium directing insert. The chamber section is further provided with a chamber inlet and a chamber outlet as means to introduce the first heat exchange medium into the chamber section, then to discharge the first heat exchange medium out of the chamber section. The medium directing insert generally may be a rectangularly shaped single planar panel member with thickness, having a first planar side and a second planar side. The first planar side of the medium directing insert is generally positioned within the chamber section at an angle, while the second planar side of the medium directing insert is similarly positioned within the chamber at an angle. The lateral sides of the medium directing insert are generally parallel to each other, wherein respective lateral sides of the medium directing insert may be located spaced apart from the chamber section interior surface.

The medium directing insert is generally utilized within the chamber section in the tube and chamber type heat exchanger to induce mixing and agitating effect to the first heat exchange medium introduced into the chamber section of the heat exchanger, resulting in improvements to convective heat transfer of the first heat exchange medium. Improved convective heat transfer rate of the heat exchange medium is generally known in the art to enhance heat transfer effectiveness of the heat exchange medium, which in turn enhances the effectiveness of the overall heat exchanger. The heat can be transferred from inside the heat exchanger to the outside, or vice versa, dependent upon the application of the heat exchanger. The chamber section is generally coupled with at least two tubular sections, comprising an inlet tube and an outlet tube, to facilitate means of introducing the first heat exchange medium into the chamber section then to discharge the first heat exchange medium out of the chamber section, respectively.

As a desire to design a smaller heat exchanger with a smaller core surface of minimal lateral and vertical dimensions is pursued, the longitudinal length of the heat exchanger may be extended, thereby by extension, extending the overall longitudinal length of the tube and chamber sections. Simply extending the longitudinal length of the tube and chamber sections may pose a problem, as such a design may adversely affect the overall performance of the typical tube and chamber heat exchanger by inefficiently utilizing the added surface area obtained by longitudinally extending the tube and chamber sections. Furthermore, simply lengthening the tube and chamber sections by coupling additional tube and chamber sections in a serial manner may further minimize the effectiveness of the heat exchanger by inducing higher pressure drop to the heat exchange medium fed inside the longitudinally extended tube and chamber sections, for example.

The present invention optimizes the heat exchange medium flow fed inside the tube and chamber sections without adversely restricting flow characteristics of the tube and chamber type heat exchangers, while optimizing the flow pattern of the heat exchange medium in desired ways, inducing greater desired mixing and agitating effect to the heat exchange medium, thereby achieving higher heat transfer performance in a smaller package, while fully utilizing the added surface area of the longitudinally extended chamber section, all without inducing greater amount of pressure drop effect to the first heat exchange medium introduced into the chamber section. The present invention further accomplishes the desired effect in a cost effective and easy to manufacture manner, thereby providing means to produce highly effective heat exchanger in a cost competitive fashion. Such heat exchanger may be desirable for use in various heat exchange applications, such as in automotive, industrial, commercial, or consumer electronics and appliance applications, for example. The present invention may be especially desirable where packaging space provided for the heat exchanger may be generally limited, or where a reduction in weight of the heat exchanger is desired.

In another type of a prior art heat exchanger, commonly called a tube and fin heat exchanger, the heat exchanger comprises of a plurality of tubular sections and fin sections stacked interchangeably together as an assembly to generally optimize ease of assembly. The tubular sections are used to transport a first heat exchange medium as well as to transfer heat between the first heat exchange medium and a second heat exchange medium. In the tube and fin heat exchanger, the second heat exchange medium is directed to flow around the exterior of the tube sections as well as around fin sections. The fin sections are attached to the exterior surface of the tube sections to supplement the tubes in transferring heat between the first heat exchange medium and the second heat exchange medium. The assembly comprising the tube sections and the fin sections, commonly referred to as a core, is designed primarily for minimizing assembly cost. The core of the heat exchanger of such a design, generally relies upon the density of fin materials packaged within the core to obtain the desired heat transfer effectiveness. As a result, when the longitudinal length of the core is extended for the desired effect, the fin sections generally must be similarly extended longitudinally to obtain the desired heat transfer effectiveness. The tube and fin heat exchanger utilize extremely thin material to form the fin sections to obtain the desired heat transfer effectiveness. Due to the fragility of the fin materials commonly utilized in such a design, longitudinally extending the fin materials generally may result in higher occurrence of damage to the fin sections, diminishing the effectiveness of the heat exchanger, or in some instances, resulting in inoperable heat exchanger by terminally restricting flow of the heat exchange medium. Furthermore, lengthening the fin sections longitudinally generally drastically increases the pressure drop effect to the heat exchange medium fed through such a contraption, reducing the effectiveness of the heat exchanger as a result by reducing the flow of the heat exchange medium. As the performance of the heat exchanger is negatively affected, the heat exchanger may need to be larger in physical size, which generally results in a need for additional raw material, which in turn results in additional weight and cost as well as requiring additional packaging space for the heat exchanger placement.

SUMMARY OF THE INVENTION

In an embodiment of the present invention, a heat exchanger is provided with a hollow, longitudinally extended body, comprising generally of two vertical panel members and two lateral panel members. The respective panel members, when combined, form a chamber assembly. In an embodiment of the present invention, the chamber assembly may be shown generally rectangular parallelepiped shaped. However, in other embodiment of the present invention, the chamber assembly may be formed into other geometric shapes, such as a cylinder or a polygonal prism, for example, whereby number of vertical panels and lateral panels may vary accordingly.

In an embodiment of the present invention, a first heat exchange medium may flow around the exterior surface of the chamber assembly, while a second heat exchange medium may be introduced into the interior of the chamber assembly. The interior of the chamber assembly is provided with, a hollow, longitudinally extended chamber space. The heat exchanger may generally be utilized to transfer heat from the first heat exchange medium to the second heat exchange medium, or vice versa depending upon the direction of heat flow. The material comprising the chamber assembly generally acts as a conduit to facilitate heat transfer between the first heat exchange medium and the second heat exchange medium. As such, as more surface area is provided by the chamber assembly, the overall heat transfer performance of the heat exchanger generally improves as a result.

The chamber assembly on a first longitudinal axial end is provided with an inlet in the form of a chamber inlet, permitting means of introducing the second heat exchange medium into the heat exchanger. On a second longitudinal axial end of the chamber assembly, an outlet in the form of a chamber outlet is provided to permit discharge means of the second heat exchange medium out of the heat exchanger. Longitudinally disposed within the chamber assembly is a medium directing assembly. The medium directing assembly is generally disposed to facilitate the desirable flow pattern of the second heat exchange medium within the chamber assembly, combining agitating and mixing effect known in the art to enhance convective heat transfer. The medium directing assembly further facilitates desirable longitudinal transport means of the second heat exchange medium within the chamber assembly, wherein the second heat exchange medium introduced from the chamber inlet is directed longitudinally towards the chamber outlet in a desirable matter, effectively utilizing the additional surface area afforded by the longitudinally extended generally rectangular parallelepiped body of the chamber assembly. The medium directing assembly yet further provides means to draw heat away or draw heat into the material comprising the chamber assembly by heat conduction means, dependent upon the heat flow direction, further improving the overall heat transfer performance of the heat exchanger.

In an embodiment of the present invention, the main means of providing transporting, agitating, as well as mixing effect to the second heat exchange medium flowing within the chamber assembly may be provided by a first medium directing panel member and by a second medium directing panel member of the medium directing assembly. The first medium directing panel member and the second medium directing panel member are each individually a generally planar panel member having a thickness. The first medium directing panel member and the second medium directing panel member each respectively have a first generally planar surface facing at an angle relative to the longitudinal axial characteristics established by the rectangular parallelepiped body of the chamber assembly, facing towards the chamber inlet. In an embodiment of the present invention, the first generally planar surface provided by the first medium directing panel member may be provided with an inclining angle relative to the longitudinal axial characteristics established by the rectangular parallelepiped body of the chamber assembly, while the first generally planar surface provided by the second medium directing panel member may be provided with a declining angle relative to the longitudinal axial characteristics established by the rectangular parallelepiped body of the chamber assembly, for example.

The first medium directing panel member and the second medium directing panel member each feature respectively on an opposite planar surface from the first planar surface, a second planar surface. The second planar surfaces respectively of the first medium directing panel member and the second medium directing panel member face the chamber outlet at an angle relative to the longitudinal axial characteristic established by the rectangular parallelepiped body of the chamber assembly. In an embodiment of the present invention, the angled plane provided by the second planar surface of the first medium directing panel member may be set at an inclining angle relative to the longitudinal axial characteristics established by the rectangular parallelepiped body of the chamber assembly, while the angled plane provided by the second planar surface of the second medium directing panel member may be set at a declining angle relative to the longitudinal axial characteristics established by the rectangular parallelepiped body of the chamber assembly, for example.

The first medium directing panel member and the second medium directing panel member each generally extend longitudinally within the chamber assembly. A first longitudinal end respectively of the first medium directing panel member and the second medium directing panel member extends longitudinally towards the first longitudinal axial end of the chamber assembly, while a second longitudinal end respectively of the first medium directing panel member and the second medium directing panel member extends longitudinally towards the second longitudinal axial end of the chamber assembly.

The first longitudinal end of the first medium directing panel member is generally located spaced apart vertically from the chamber assembly, while the second longitudinal end of the first medium directing panel member may generally engage the chamber assembly, provided as a result an angled relationship to the plane established by the first medium directing panel member relative to the plane established by the chamber assembly. Further, the lateral width of the first medium directing panel member on the first longitudinal end may be generally wider than the lateral width of the first medium directing panel member on the second longitudinal end.

Located generally vertically below the first medium directing panel member is the second medium directing panel member. The first longitudinal end of the second medium directing panel member is generally located vertically spaced apart from the chamber assembly, while the second longitudinal end of the second medium directing panel member generally engages the chamber assembly, providing an angled relationship to the plane established by the second medium directing panel member relative to the plane established by the chamber assembly. The lateral width of the second medium directing panel member on the first longitudinal end may be generally wider than the lateral width of the second medium directing panel member on the second longitudinal end.

In an embodiment of the present invention, the first longitudinal end respectively of the first medium directing panel member and the second medium directing panel member may engage each other forming a medium flow partition line. The medium flow partition line is generally a physical flow diverting member that may facilitate the desired distribution of the second heat exchange medium within the chamber assembly. In an embodiment of the present invention, the medium flow partition line may be utilized to vertically distribute the second heat exchange medium introduced into the chamber assembly as a singular flow into generally two distinct vertical heat exchange medium flow streams for the desired effect.

In an embodiment of the present invention, a first lateral side edge and a second lateral side edge of the first medium directing panel member towards the first longitudinal end is generally in close proximity to the lateral sides of the chamber assembly, while the first lateral side edge and the second lateral side edge towards the second longitudinal end of the first medium directing panel member is generally set a further distance away from the respective lateral sides of the chamber assembly, providing an inwardly tapered appearance to the plane established by the first medium directing panel member as the first medium directing panel member extends longitudinally within the chamber assembly. Similarly, the second medium directing panel member is generally wider on the first longitudinal end than the second longitudinal end, providing an inwardly tapered appearance to the plane established by the second medium directing panel member as the second medium directing panel member extends longitudinally within the chamber assembly.

To achieve desirable heat transfer performance in a heat exchanger, it is generally known in the art that providing the agitating effect to the flow of the heat exchange medium as well as providing mixing effect to the heat exchange medium offer favorable effect by improving the convective heat transfer of the heat exchange medium. In an embodiment of the present invention, the medium directing assembly provides a desirable heat exchange medium transport means of the second heat exchange medium flowing within the chamber assembly, whereby effectively utilizing the longitudinally extended surface provided for heat transfer by the generally rectangular parallelepiped body of the chamber assembly, while simultaneously providing mixing effect and agitating effect to the second heat exchange medium introduced into the chamber assembly, enhancing the overall performance of the heat exchanger assembly as a result. By effectively utilizing the heat transfer surface area provided by the chamber assembly, the present invention allows for heat exchange device having a smaller core surface comprising shorter lateral width and shorter vertical height than that of comparable conventional prior art heat exchangers, thereby permitting means of packaging the heat exchange device in a space restricted application, for example. Smaller heat exchange device dimensions further lend to savings in raw material usage, which by extension results in weight reduction as well as cost savings.

The second heat exchange medium is generally introduced into the chamber assembly through the chamber inlet, generally flowing as a singular flow conforming to the longitudinal axial characteristics established by the rectangular parallelepiped body of the chamber assembly. Once inside the chamber assembly, in an embodiment of the present invention, the second heat exchange medium is generally diverted into two separate divergent flows by the medium flow partition line, wherein a portion of the second heat exchange medium flow is directed towards the first planar surface of the first medium directing panel member, while generally the remainder of the second heat exchange medium flow introduced into the chamber assembly is directed towards the first planar surface of the second medium directing panel member.

As the second heat exchange medium flow is diverted into two separate vertical flows by the medium flow partition line, the two separate flows are each directed to collide with the first planar surface respectively of the first medium directing panel member and the second medium directing panel member, introducing desirable mixing and agitating effect to the second heat exchange medium, thereby enhancing heat convection effect of the second heat exchange medium, while the angled plane of the respective medium directing panel members relative to the longitudinal axial characteristics of the chamber assembly minimizes pressure drop effect to the second heat exchange medium. The first medium directing panel member and the second medium directing panel member further having a laterally wider first longitudinal end towards the first longitudinal axial end of the chamber assembly facing the chamber inlet, the first medium directing panel member and the second medium directing panel member initially facilitate desirable longitudinal movement of the second heat exchange medium within the chamber assembly.

The second heat exchange medium directed towards the first planar surface of the first medium directing panel initially generally travel longitudinally within the chamber assembly, while simultaneously moving vertically upwardly following the surface of the first planar surface established by the first medium directing panel member, wherein the flow is generally directed towards a first vertical side of the chamber assembly. Meanwhile, the second heat exchange medium flow directed towards the first planar surface established by the second medium directing panel member, initially travel longitudinally within the chamber assembly, while simultaneously moving vertically downwardly following the surface of the first planar surface established by the second medium directing panel member, generally directing the second heat exchange medium towards a second vertical side of the chamber assembly. The act of directing heat exchange medium flow to a static planar surface is generally known in the act to enhance heat transfer effectiveness by inducing mixing and agitating effect to the heat exchange medium, which generally results in improved heat convection effects.

The first medium directing panel and the second medium directing panel member each respectively feature a tapered planar surface wherein the lateral width towards the first longitudinal end of respective panels is generally wider than the lateral width of the respective medium directing panels on the second longitudinal end. The space formed between a first lateral side of the chamber assembly and a first lateral edge of the first medium directing panel forms a first upper lateral medium directing passageway, a fluid passageway permitting the flow of the second heat exchange medium therethrough. In a similar fashion, the space formed between the first lateral side of the chamber assembly and a first lateral edge of the second medium directing panel member forms a first lower lateral medium directing passageway, a fluid passageway permitting the flow of the second heat exchange medium therethrough.

The lateral spacing provided on a second lateral side respectively of the first medium directing panel and the second medium directing panel member similarly increases towards the second longitudinal end of the respective medium directing panels. The space formed between a second lateral side of the chamber assembly and a second lateral edge of the first medium directing panel member forms a second upper lateral medium directing passageway, a fluid passageway permitting the flow of the second heat exchange medium therethrough. The space formed between the second lateral side of the chamber assembly and a second lateral edge of the second medium directing panel member forms a second lower lateral medium directing passageway, a fluid passageway permitting the flow of the second heat exchange medium therethrough.

The flow of the second heat exchange medium diverted towards the first planar surface of the first medium directing panel member within the chamber assembly initially generally travel longitudinally following the surface of the first planar surface of the first medium directing panel member, while vertically directed towards the first vertical side of the chamber assembly. As the second heat exchange medium travels further longitudinally within the chamber assembly, the flow of the second heat exchange medium is simultaneously diverted into two semi-circular divergent flow paths as the second longitudinal end of the first medium directing panel member generally engages the first vertical side of the chamber assembly, thereby restricting further longitudinal movement of the second heat exchange medium in an embodiment of the present invention.

As a result, the portion of the second heat exchange medium diverted towards the first medium directing panel member is further directed to flow towards the first upper lateral medium directing passageway and the second upper lateral medium directing passageway. The flow of the second heat exchange medium diverted to flow towards the first upper lateral medium directing passageway and towards the second upper lateral medium directing passageway each generally flows in a longitudinally extended arcuate fashion, generally in a divergent lateral direction. The longitudinally extended arcuate flow of the second heat exchange medium directed towards the first upper lateral medium directing passageway generally crests around the first lateral edge of the first medium directing panel member, while the longitudinally extended arcuate flow directed towards the second upper lateral medium directing passageway generally crests around the second lateral edge of the first medium directing panel member.

The flow directional changes afforded by the diversion of the second heat exchange medium into two laterally divergent arcuate flows generally provides desirable mixing and agitating effect to the second heat exchange medium, which generally provides desirable effects of enhancing heat convection known in the art. Furthermore, the flow directional changes provide agitating effect by first directing a portion of the second heat exchange medium towards the first lateral side of the chamber assembly, while the remainder of the second heat exchange medium is directed towards the second lateral side of the chamber assembly, directly impacting the respective flow of the second heat exchange medium into respective lateral sides of the chamber assembly, generally known in the art to improve heat transfer efficiency by agitating the established heat exchange medium flow by directing the heat exchange medium flow directly into static heat conducting surfaces. The respective flow of the second heat exchange medium directed towards the first upper lateral medium directing passageway and the second upper lateral medium directing passageway continues its longitudinally extended arcuate flow once cresting over the first lateral edge of the first medium directing panel member and the second lateral edge of the first medium directing panel member, respectively.

The flow of the second heat exchange medium diverted towards the first planar surface of the second medium directing panel member within the chamber assembly similarly generally travel longitudinally following the surface of the first planar surface of the second medium directing panel member, while vertically generally directed towards the second vertical side of the chamber assembly. As the second heat exchange medium further travels longitudinally within the chamber assembly, following the contour of the first planar surface of the second medium directing panel member, the flow of the second heat exchange medium is simultaneously diverted into two semi-circular divergent lateral flow paths as the second longitudinal end of the second medium directing panel member generally engages the chamber assembly, thereby restricting further longitudinal movement of the second heat exchange medium in an embodiment of the present invention.

A portion of the second heat exchange medium flow diverted towards the first planar surface of the second medium directing panel member is further diverted towards the first lower lateral medium directing passageway, while generally the remainder of the second heat exchange medium is diverted towards the second lower lateral medium directing passageway. The second heat exchange medium diverted to flow towards the first lower lateral medium directing passageway and towards the second lower lateral medium directing passageway each generally flows in a longitudinally extended arcuate fashion, generally in a divergent lateral direction. The longitudinally extended arcuate flow directed towards the first lower lateral medium directing passageway generally crests around the first lateral edge of the second medium directing panel member, while the longitudinally extended arcuate flow directed towards the second lower lateral medium directing passageway generally crests around the second lateral edge of the second medium directing panel member.

The directional flow changes afforded by the diversion of the second heat exchange medium into two arcuate flows generally provide desirable mixing and agitating effect to the second heat exchange medium, which generally provides desirable effects of enhancing heat convection known in the art. Furthermore, the flow directional changes provide agitating effect by first directing a portion of the second heat exchange medium towards the first lateral side of the chamber assembly, while the remainder of the second heat exchange medium is directed towards the second lateral side of the chamber assembly, directly impacting the respective flow of the second heat exchange medium into the chamber assembly. The act of directing a heat exchange medium flow towards a static planar surface provided for heat conducting purposes is generally known in the art to improve heat transfer efficiency by improving heat convection of the heat exchange medium. The flow of the second heat exchange medium directed towards the first lower lateral medium directing passageway and the second lower lateral medium directing passageway each respectively continues its longitudinally extended arcuate flow once cresting over the first lateral edge of the second medium directing panel member and the second lateral edge of the second medium directing panel member, respectively.

The flow of the second heat exchange medium diverted towards the first planar surface of the first medium directing panel member that has been diverted into further two distinct flow directions, one towards the first upper lateral medium directing passageway and the other towards the second upper lateral medium directing passageway, are generally directed to flow into each other on the second planar side of the first medium directing panel member, wherein the two separate flows are generally merged into a singular flow once again. The flow of the second heat exchange medium diverted towards the first planar surface of the second medium directing panel member that has been diverted into further two distinct flow directions, one towards the first lower lateral medium directing passageway and the other towards the second lower lateral medium directing passageway, are similarly directed to flow into each other on the second planar side of the second medium directing panel member, generally merging into a singular flow.

On the second planar side respectively of the first medium directing panel member and the second medium directing panel member, the second heat exchange medium that was diverted into four distinct flow paths comprising the first upper lateral medium directing passageway, the second upper lateral medium directing passageway, the first lower lateral medium directing passageway, and the second lower lateral medium directing passageway are generally directed to merge into generally a singular flow once again within the chamber assembly. Once generally merged into a singular flow within the chamber assembly, flow characteristics of the second heat exchange medium generally maintain its agitated flow state as four distinct flow streams are mixed together, until eventually settling to conform to a unitary flow stream. The flow of the second heat exchange medium generally eventually conforms to the longitudinal axial characteristics established by the chamber assembly, while being directed to flow towards the chamber outlet. Once the second heat exchange medium reaches the chamber outlet, the second heat exchange medium is then discharged out of the chamber assembly, thereby discharged out of the heat exchanger by extension.

In an embodiment of the present invention, a plurality of heat exchanger described herein may be coupled together to form a larger heat exchange assembly to facilitate greater heat transfer performance. As the material forming the chamber assembly generally facilitate as a conduit to transfer heat between the first heat exchange medium and the second heat exchange medium, the greater the number of chamber assembly bundled together to form a heat exchanger assembly, generally the greater the heat transfer capacity.

In an embodiment of the present invention, the heat exchanger assembly may be provided with a core assembly. The core assembly comprises a plurality of heat exchanger bundled together. The core assembly may be laterally bound on a first lateral side by a first core lateral wall and on a second lateral side by a second core lateral wall, establishing a first and a second lateral side of the heat exchanger assembly. The first core lateral wall and the second core lateral wall may each individually be a generally planar panel member having a thickness. On the vertical sides of the core assembly, the core assembly may be vertically bound by an inlet tank on a first vertical side and an outlet tank on a second vertical side, establishing a first and a second vertical side of the heat exchanger assembly. The inlet tank and the outlet tank may each individually be a hollow member, capable of containing the first heat exchange medium therein for the desired effect. A first longitudinal end of the core assembly generally establishes the frontal surface of the heat exchanger assembly, while a second longitudinal end of the core assembly generally establishes the backside surface of the heat exchanger assembly.

The first longitudinal end and the second longitudinal end of the core assembly, along with the first core lateral wall, the second core lateral wall, the inlet tank, and the outlet tank form a fluid containing vessel, a vessel that may be used to contain the first heat exchange medium therein. The heat exchanger assembly may be shown generally as rectangular in shape, however, in other embodiment of the present invention, the heat exchanger assembly may be shaped into other geometric shapes, such as a trapezoidal shape or a cylindrical shape, for example.

The inlet tank may be provided with a heat exchanger assembly inlet, a generally hollow tubular member having a first end extending away from the inlet tank and a second end coupled to the inlet tank. The heat exchanger assembly inlet is fluidly connected to the inlet tank, thereby providing means to introduce the first heat exchange medium into the heat exchanger assembly. The heat exchanger assembly inlet may be shown as generally cylindrical in shape, however, it may be shaped into other geometric shapes such as a rectangular parallelepiped, for example.

The outlet tank may be provided with a heat exchanger assembly outlet, a generally hollow tubular member having a first end extending away from the outlet tank and a second end coupled to the outlet tank. The heat exchanger assembly outlet and the outlet tank may be fluidly connected to each other, thereby providing means to discharge the first heat exchange medium out of the heat exchanger assembly. The heat exchanger assembly outlet may be shown as generally cylindrical in shape, however, it may be shaped into other geometric shapes such as a rectangular parallelepiped, for example. In an embodiment of the present invention, the first heat exchange medium may be recirculated as part of a cooling loop or a heat source, dependent upon the application of the heat exchanger assembly.

In another embodiment of the medium directing assembly, the medium directing assembly may be provided with two generally planar panel members comprising an upper mating panel member and a lower mating panel member to further enhance the heat transfer rate of the chamber assembly. The upper mating panel member may be coupled to the second longitudinal end of the first medium directing panel member, while the lower mating panel member may be coupled to the second longitudinal end of the second medium directing panel member. The upper mating panel member and the lower mating panel member may each individually be provided with a first planar surface and a second planar surface, wherein the first planar surface of the upper mating panel member may engage the interior surface of the chamber assembly, thereby providing additional heat conducting surface between the chamber assembly and the medium directing assembly, generally enhancing the overall heat transfer effectiveness of the heat exchanger. One of the planar surfaces provided by the lower mating panel member may be similarly positioned, engaging the interior of the chamber assembly for a similar effect.

In yet another embodiment of a medium directing assembly, a distribution support member may be provided between the upper mating panel member and the lower mating panel member for further enhancement of the overall heat transfer effectiveness of the heat exchanger. The distribution support member may generally be a planar panel member having a thickness, disposed between the upper mating panel member and the lower mating panel member, wherein a first vertical edge of the distribution support member engages the upper mating panel member, while a second vertical edge of the distribution support member engages the lower mating panel member. The distribution support member is generally provided with a first planar surface and a second planar surface, wherein the second planar surface is located generally on the opposite side of the first planar surface. The first planar surface and the second planar surface of the distribution support member are generally positioned transversely relative to the planes established by the first planar surface and the second planar surface, respectively, of the upper mating panel member and the lower mating panel member.

The first planar surface and the second planar surface of the distribution support member provides additional heat transfer surfaces as well as enhanced structural rigidity to the medium directing assembly. To further improve heat transfer, the second heat exchange medium diverted towards the first lateral edge respectively of the first medium directing panel member and the second medium directing panel member may be directed towards the first planar surface of the distribution support member, while the second heat exchange medium diverted towards the second lateral edge respectively of the first medium directing panel member and the second medium directing panel member may be directed towards the second planar surface of the distribution support member. The action of directing the flow of heat exchange medium towards a static heat transfer surface is generally known in the art to improving heat transfer effectiveness, by introducing swirling and mixing action to the heat transfer medium, thereby improving heat convection.

In an embodiment of the heat exchanger assembly, the plurality of heat exchangers may be coupled together, while facilitating means of providing passageways for the first heat transfer medium to flow around the outer surface of the individual heat exchanger. In an embodiment of the heat exchanger, a first longitudinal spacing member may be provided on a first longitudinal end of each of the plurality of heat exchanger, while a second longitudinal spacing member may be provided on a second longitudinal end of each of the plurality of heat exchanger, providing a desirable vertical and horizontal spacing arrangement between the plurality of heat exchanger that may be packaged in the heat exchanger assembly. The first longitudinal spacing member and the second longitudinal spacing member may be extended or shortened to obtain the desired horizontal and vertical passageway spacing around the heat exchanger for the desired effect.

The heat exchanger or the heat exchanger assembly may be utilized as a cooler, a condenser, an evaporator, a radiator, an oil cooler or any other application requiring heat to be transferred from one heat exchange medium to another heat exchange medium. The heat exchanger or the heat exchanger assembly may be for use in various heat exchange applications, such as in automotive, industrial, commercial, or consumer electronics and appliance applications, for example, where packaging space provided for the heat exchanger may be generally limited or where reduction in weight of the heat exchanger is desired. The first heat exchange medium, as well as the second heat exchange medium utilized in the heat exchanger or the heat exchanger assembly, may be air, liquid, or gas, known in the art. In an embodiment of the present invention, more than one type of heat exchange medium may be utilized. Furthermore, in some embodiments of the present invention, the first heat exchange medium, as well as the second heat exchange medium, may be combined with more than one type of material, such as with air and silica gel solids to obtain additional desired features, for example.

In an embodiment of the present invention, various components of the heat exchanger or the heat exchanger assembly may be produced of ferrous or non-ferrous material. Similarly, the components may be made of plastics or composite materials. The various components may be produced of the same material or may be produced of dissimilar materials. Various bonding and brazing means may be utilized, which may include but not limited to adhesives, epoxy, mechanical means, or brazing and soldering, for example. In another embodiment of the present invention, various components may be welded without additional bonding material, such as in the case of laser welding. In yet another embodiment of the present invention, a portion or all the components comprising the heat exchanger may be manufactured by means of 3D printing technology, known in the art.

Other features and advantages of the present invention will be readily appreciated, as the same becomes better understood after reading the subsequent description taken in conjunction with the accompanying drawings.

BRIEF DESCRIPTIONS OF THE DRAWINGS

DETAILED DESCRIPTION

Figure 1:
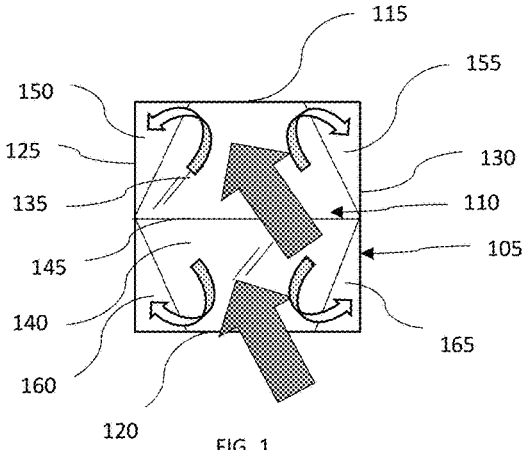
FIG. 1 is a schematic frontal view of a heat exchanger according to an embodiment of the present invention, with general internal heat exchange medium flow shown by arrows.
Figure 4:
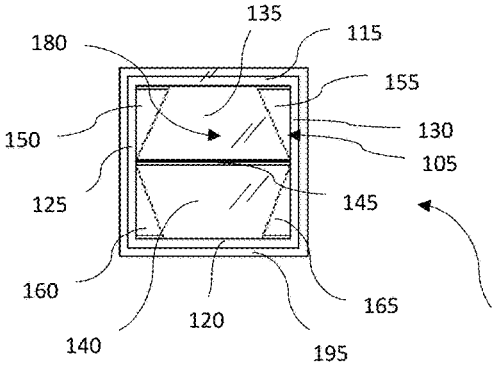
FIG. 4 is a frontal view of a heat exchanger according to an embodiment of the present invention.

Referring to the drawings and in particular FIGS. 1 and 4, an embodiment of a heat exchanger 100 is shown. In an embodiment of the present invention, the heat exchanger 100 is provided with a hollow, longitudinally extended body that may be shown to be generally rectangular parallelepiped shaped. The hollow, longitudinally extended rectangular parallelepiped body may be provided by two vertical panels comprising a first vertical chamber panel member 115 and a second vertical chamber panel member 120, and two lateral panels comprising a first lateral chamber panel member 125 and a second lateral chamber panel member 130, which when combined together forms a chamber assembly 105. The first vertical chamber panel member 115, the second vertical chamber panel member 120, the first lateral chamber panel member 125, and the second lateral chamber panel member 130 are each generally a planar panel member having a thickness. In other embodiment of the present invention, however, the chamber assembly 105 may be formed into other geometric shapes, such as a cylinder or a polygonal prism, for example, whereby the number of vertical panels and lateral panels may vary accordingly.

Figure 3:
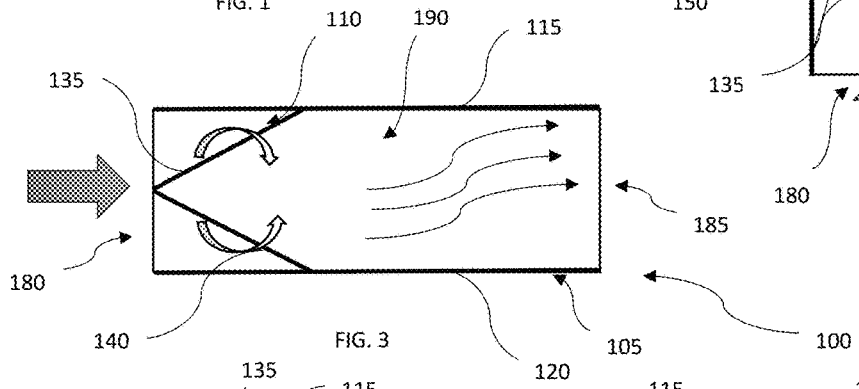
FIG. 3 is a schematic side view of a heat exchanger according to an embodiment of the present invention, with general internal heat exchange medium flow shown by arrows.

Referring now to FIGS. 1 and 3, a first heat exchange medium may flow around the exterior surface of the chamber assembly 105, while a second heat exchange medium may be introduced into the interior of the chamber assembly 105 into a chamber 190, a hollow, longitudinally extended chamber provided within the chamber assembly 105. The heat exchanger 100 may generally be utilized to transfer heat from the first heat exchange medium to the second heat exchange medium, or vice versa depending upon the direction of heat flow. The material comprising the chamber assembly 105, generally acts as a conduit to facilitate heat transfer between the first heat exchange medium and the second heat exchange medium. As such, as more surface area is provided by the chamber assembly 105, the overall heat transfer performance of the heat exchanger 100 generally improves as a result.

The chamber assembly 105 generally comprises the first vertical chamber panel member 115, the second vertical chamber panel member 120, the first lateral chamber panel member 125, and the second lateral chamber panel member 130 coupled together. In an embodiment of the present invention, a first lateral edge of the first vertical chamber panel member 115 engages a first vertical edge of the first lateral chamber panel member 125 while a second lateral edge of the first vertical chamber panel member 115 engages a first vertical edge of the second lateral chamber panel member 130. In a similar fashion, a first lateral edge of the second vertical chamber panel member 120 engages a second vertical edge of the first lateral chamber panel member 125, while a second lateral edge of the second vertical chamber panel member 120 engages a second vertical edge of the second lateral chamber panel member 130.

The chamber assembly 105 on a first longitudinal axial end is provided with an inlet in the form of a chamber inlet 180, permitting means to introduce the second heat exchange medium into the heat exchanger 100. On a second longitudinal axial end of the chamber assembly 105, an outlet in the form of a chamber outlet 185 is provided to permit discharge means of the second heat exchange medium out of the heat exchanger 100. In an embodiment of the present invention, the chamber inlet 180 may be generally open to atmosphere, fluidly connecting the atmosphere to the chamber 190. In an embodiment of the present invention, the second heat exchange medium may be air. However, in other embodiment of the present invention, the second heat exchange medium may be other gas or liquid, for example. In an embodiment of the present invention, the chamber outlet 185 may similarly be generally open to atmosphere, fluidly connecting the chamber 190 to the atmosphere. Referring to the drawings FIGS. 4 and 5, in an embodiment of the present invention shown, the chamber inlet 180 and the chamber outlet 185 may be generally shown to be square in shape. However, in other embodiment of the present invention, the respective openings may be formed into other geometric shapes, such as a rectangle, a circle, or a polygon, for example.

Figure 2:
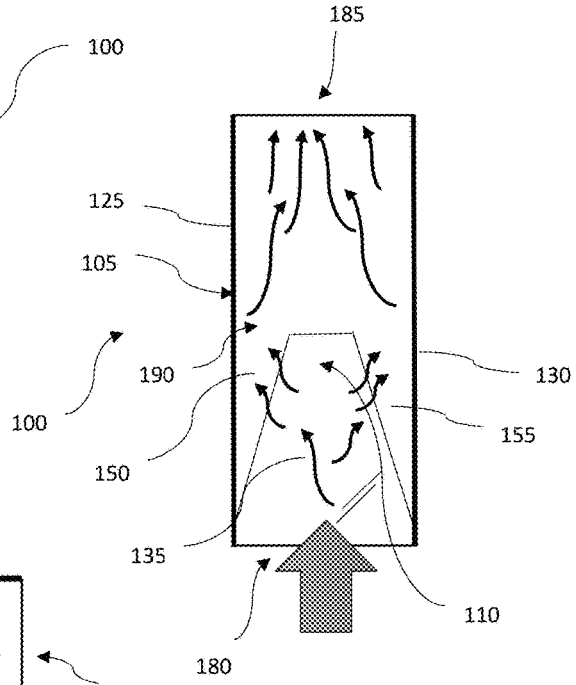
FIG. 2 is a schematic top view of a heat exchanger according to an embodiment of the present invention, with general internal heat exchange medium flow shown by arrows.

Referring now to FIGS. 2 and 3, longitudinally disposed within the chamber 190 is a medium directing assembly 110. The medium directing assembly 110 is generally disposed within the chamber 190 to facilitate desirable flow pattern of the second heat exchange medium introduced into the chamber 190, combining agitating and mixing effect known in the art to enhance convective heat transfer. The medium directing assembly 110 further facilitates desirable longitudinal transport means of the second heat exchange medium within the chamber 190, wherein the second heat exchange medium introduced in from the chamber inlet 180 is directed longitudinally towards the chamber outlet 185 in a desirable matter, effectively utilizing the additional surface area afforded by the longitudinally extended generally rectangular parallelepiped body of the chamber assembly 105. The medium directing assembly 110 yet further provides means to draw heat away or draw heat into the material comprising the chamber assembly 105 by heat conduction means, dependent upon the heat flow direction, further improving the overall heat transfer performance of the heat exchanger 100.

In an embodiment of the present invention, the main means of providing transporting, agitating, as well as mixing effect to the second heat exchange medium flowing within the chamber assembly 105 may be provided by a first medium directing panel member 135 and by a second medium directing panel member 140 of the medium directing assembly 110. The first medium directing panel member 135 and the second medium directing panel member 140 are each individually a generally planar panel member having a thickness. The first medium directing panel member 135 and the second medium directing panel member 140 each respectively have a first generally planar surface facing at an angle relative to the longitudinal axial characteristics established by the rectangular parallelepiped body of the chamber assembly 105 towards the chamber inlet 180. In an embodiment of the present invention, the first generally planar surface provided by the first medium directing panel member 135 may be provided with an inclining angle relative to the longitudinal axial characteristics established by the rectangular parallelepiped body of the chamber assembly 105, while the first generally planar surface provided by the second medium directing panel member 140 may be provided with a declining angle relative to the longitudinal axial characteristics established by the rectangular parallelepiped body of the chamber assembly 105, for example.

The first medium directing panel member 135 and the second medium directing panel member 140 each feature respectively on an opposite planar surface from the first planar surface, a second planar surface. The second planar surfaces respectively of the first medium directing panel member 135 and the second medium directing panel member 140 face the chamber outlet 185 at an angle relative to the longitudinal axial characteristic established by the rectangular parallelepiped body of the chamber assembly 105. In an embodiment of the present invention, the angled plane provided by the second planar surface of the first medium directing panel member 135 may be set at an inclining angle relative to the longitudinal axial characteristics established by the rectangular parallelepiped body of the chamber assembly 105, while the angled plane provided by the second planar surface of the second medium directing panel member 140 may be set at a declining angle relative to the longitudinal axial characteristics established by the rectangular parallelepiped body of the chamber assembly 105, for example.

Referring to FIG. 3, the first medium directing panel member 135 and the second medium directing panel member 140 each generally extend longitudinally within the chamber 190. A first longitudinal end respectively of the first medium directing panel member 135 and the second medium directing panel member 140 extend longitudinally towards a first longitudinal axial end of the chamber 190, while a second longitudinal end respectively of the first medium directing panel member 135 and the second medium directing panel member 140 extend longitudinally towards a second longitudinal axial end of the chamber 190. In an embodiment of the present invention, the first longitudinal end respectively of the first medium directing panel member 135 and the second medium directing panel member 140 may be generally shown to terminate at the first longitudinal axial end of the chamber 190. However, in other embodiment of the present invention, the first longitudinal end respectively of the first medium directing panel member 135 and the second medium directing panel member 140 may extend beyond the first longitudinal axial end of the chamber 190 (Not shown). In yet another embodiment of the present invention, respective first longitudinal ends of the first medium directing panel member 135 and the second medium directing panel member 140 may terminate prior to reaching the first longitudinal axial end of the chamber 190 for the desired effect (Not shown).

In an embodiment of the present invention, the second longitudinal end respectively of the first medium directing panel member 135 and the second medium directing panel member 140 may be shown generally terminating within the chamber 190. In other embodiment of the present invention, the second longitudinal end respectively of the first medium directing panel member 135 and the second medium directing panel member 140 may extend to the second longitudinal axial end of the chamber 190 (Not shown). In yet another embodiment of the present invention, the second longitudinal end respectively of the first medium directing panel member 135 and the second medium directing panel member 140 may extend beyond the second longitudinal axial end of the chamber 190 for the desired effect (Not shown).

Now referring to FIGS. 3 and 4, the first longitudinal end of the first medium directing panel member 135 is generally located spaced apart vertically from the first vertical chamber panel member 115, while the second longitudinal end of the first medium directing panel member 135 may be shown generally engaging the first vertical chamber panel member 115, providing an angled relationship to the plane established by the first medium directing panel member 135 relative to the plane established by the first vertical chamber panel member 115. In another embodiment of the present invention, the first longitudinal end of the first medium directing panel member 135 may be positioned spaced apart from the first vertical chamber panel member 115, while the second longitudinal end of the first medium directing panel member 135 may be positioned in closer proximity to the first vertical chamber panel member 115 away from the central axis of the chamber 190, although the second longitudinal end of the first medium directing panel member 135 may not engage the first vertical chamber panel member 115 (Not shown). The lateral width of the first medium directing panel member 135 on the first longitudinal end may be shown generally wider than the lateral width of the first medium directing panel member 135 on the second longitudinal end. In yet another embodiment of the present invention, the lateral width of the first medium directing panel member 135 may vary, with the width on the first longitudinal end being wider than at least part section of the lateral width of the first medium directing panel member 135 along the longitudinal span of the first medium directing panel member 135.

Located generally vertically below the first medium directing panel member 135 is the second medium directing panel member 140. The first medium directing panel member 135 generally occupies a vertical space above the vertical plane occupied by the second medium directing panel member 140. The first longitudinal end of the second medium directing panel member 140 is generally located vertically spaced apart from the second vertical chamber panel member 120, while the second longitudinal end of the second medium directing panel member 140 generally engages the second vertical chamber panel member 120, providing an angled relationship to the plane established by the second medium directing panel member 140 relative to the plane established by the second vertical chamber panel member 120. In another embodiment of the present invention, the first longitudinal end of the second medium directing panel member 140 may be positioned spaced apart from the second vertical chamber panel member 120, while the second longitudinal end of the second medium directing panel member 140 may be positioned in close proximity to the second vertical chamber panel member 120 away from the central axis of the chamber 190, although the second longitudinal end of the second medium directing panel member 140 may not engage the second vertical chamber panel member 120 (Not shown).

The lateral width of the second medium directing panel member 140 on the first longitudinal end may be shown generally wider than the lateral width of the second medium directing panel member 140 on the second longitudinal end.

In yet another embodiment of the present invention, the lateral width of the second medium directing panel member 140 may vary, with the width on the first longitudinal end being wider than at least part section of the lateral width of the second medium directing panel member 140 along the longitudinal span of the second medium directing panel member 140.

In an embodiment of the present invention, the first longitudinal end respectively of the first medium directing panel member 135 and the second medium directing panel member 140 may be shown engaging each other forming a medium flow partition line 145. The medium flow partition line 145 is generally a physical flow diverting member that may facilitate the desired distribution of the second heat exchange medium within the chamber 190. In an embodiment of the present invention, the medium flow partition line 145 may be utilized to vertically distribute the second heat exchange medium introduced into the chamber 190 in an initial line of flow into generally two separate vertical heat exchange medium flow streams for the desired effect. In other embodiment of the present invention, the first longitudinal end respectively of the first medium directing panel member 135 and the second medium directing panel member 140 may not engage each other for a different desired effect (Not shown), which may distribute the second heat exchange medium introduced into the chamber 190 into three distinct flow streams, wherein a portion of the second heat exchange medium may be distributed towards the first medium directing panel member 135, a portion towards the second medium directing panel member 140, and the remainder to flow in between the first medium directing panel member 135 and the second medium directing panel member 140.

Figure 5:
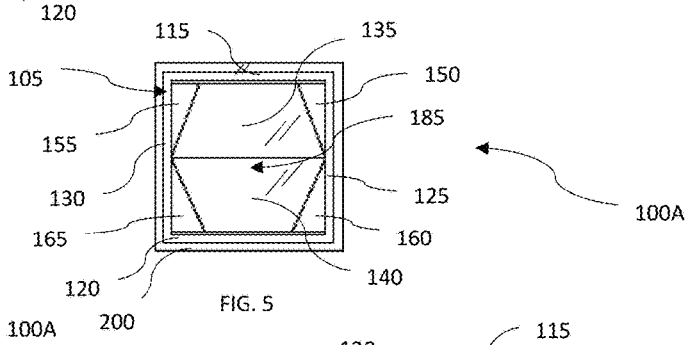
FIG. 5 is a back view of a heat exchanger according to an embodiment of the present invention.

In an embodiment of the present invention, now referencing FIGS. 4 and 5, as the first longitudinal end of the first medium directing panel member 135 is generally wider on the first longitudinal end in relation to the second longitudinal end, an edge provided on a first lateral side of the first medium directing panel member 135 is generally set at an acute angle relative to the laterally adjacent plane established by the first lateral chamber panel member 125. Similarly, an edge provided on a second lateral side of the first medium directing panel member 135 is generally set at an acute angle relative to the laterally adjacent plane established by the second lateral chamber panel member 130. As a result, the first lateral side edge and the second lateral side edge of the first medium directing panel member 135 towards the first longitudinal end is generally in close proximity to the first lateral chamber panel member 125 and the second lateral chamber panel member 130, respectively, while the first lateral side edge and the second lateral side edge towards the second longitudinal end of the first medium directing panel member 135 is generally set a further distance away from the respective lateral walls of the chamber assembly 105, providing an inwardly tapered appearance (See FIG. 2) to the plane established by the first medium directing panel member 135 as the first medium directing panel member 135 extends longitudinally within the chamber 190.

Referring again to FIGS. 4 and 5, in a similar fashion to the first medium directing panel member 135, the second medium directing panel member 140 is generally wider on the first longitudinal end than the second longitudinal end. In an embodiment of the present invention, an edge provided on a first lateral side of the second medium directing panel member 140 is generally set at an acute angle relative to the laterally adjacent plane established by the first lateral chamber panel member 125. Similarly, an edge provided on a second lateral side of the second medium directing panel member 140 is generally set at an acute angle relative to the laterally adjacent plane established by the second lateral chamber panel member 130. As a result, the first lateral side edge and the second lateral side edge of the second medium directing panel member 140 towards the first longitudinal end is generally located in close proximity to the first lateral chamber panel member 125 and the second lateral chamber panel member 130, respectively, while the first lateral side edge and the second lateral side edge towards the second longitudinal end of the second medium directing panel member 140 is generally set a further distance away from the respective lateral walls of the chamber assembly 105, giving an inwardly tapered appearance to the plane established by the second medium directing panel member 140 as the second medium directing panel member 140 extends longitudinally within the chamber 190.

To achieve a desirable heat transfer performance in a heat exchanger, it is generally known in the art that providing agitating effect to the flow of the heat exchange medium as well as providing mixing effect to the heat exchange medium offer favorable effect by improving the convective heat transfer rate of the heat exchange medium. In an embodiment of the present invention, the medium directing assembly 110 provides a desirable heat exchange medium transport means of the second heat exchange medium flowing within the chamber assembly 105, whereby effectively utilizing the longitudinally extended surface provided for heat transfer by the generally rectangular parallelepiped body of the chamber assembly 105, while providing mixing effect and agitating effect to the second heat exchange medium introduced into the chamber assembly 105, enhancing the overall performance of the heat exchanger 100 as a result. By effectively utilizing the heat transfer surface area provided by the chamber assembly 105, while enhancing the heat transfer effectiveness by inducing mixing and agitating effect to the second heat exchange medium flowing within the chamber assembly 105, the present invention allows for heat exchange device having a smaller core surface comprising shorter lateral width and shorter vertical height than that of comparable conventional prior art heat exchangers, thereby permitting means to package the heat exchange device in a space restricted application, for example, while maintaining equal or improved performance in a smaller package. Smaller heat exchange device further lends to savings in raw material usage, which by extension results in a reduction in weight as well as cost savings.

Referring to FIGS. 2 and 3, the second heat exchange medium is generally introduced into the chamber 190 through the chamber inlet 180, generally initially flowing in the initial line of flow conforming to the longitudinal axial characteristics established by the rectangular parallelepiped body of the chamber assembly 105. Once inside the chamber 190, in an embodiment of the present invention, the second heat exchange medium is generally diverted into two separate divergent vertical flow by the medium flow partition line 145, wherein a portion of the second heat exchange medium flow is directed towards the first planar surface of the first medium directing panel member 135, while generally the remainder of the second heat exchange medium flow introduced into the chamber 190 is directed towards the first planar surface of the second medium directing panel member 140. As the second heat exchange medium flow is diverted into two separate vertical flows by the medium flow partition line 145, the two separate flows are each directed to collide with the first planar surface respectively of the first medium directing panel member 135 and the second medium directing panel member 140.

Directing the flow of the heat exchange medium towards a static planar surface is known in the art to generally enhance heat transfer effectiveness by offering agitating effect to the heat exchange medium flow. The respective first planar surface of the first medium directing panel member 135 and the second medium directing panel member 140, further having an angled axial relationship to the longitudinal axial characteristics established by the chamber 190, provides the desirable agitating effect to the flow of the second heat exchange medium, while minimizing pressure drop effect to the flow of the second heat exchange medium.

The first medium directing panel member 135 and the second medium directing panel member 140 further having a laterally wider first longitudinal end towards the first longitudinal axial end of the chamber 190 facing the chamber inlet 180, the first medium directing panel member 135 and the second medium directing panel member 140 initially facilitate longitudinal movement of the second heat exchange medium within the chamber 190 towards the second longitudinal end of the chamber 190, directing the flow of the second heat exchange medium longitudinally within the chamber 190 along the respective first planar surfaces established by the first medium directing panel member 135 and by the second medium directing panel member 140, providing effective means of utilizing the longitudinally extended surface area offered by the chamber assembly 105 for heat transfer purposes.

The second heat exchange medium directed towards the first planar surface of the first medium directing panel member 135 generally travel longitudinally within the chamber 190, while simultaneously moving vertically upwardly following the surface of the first planar surface established by the first medium directing panel member 135, wherein the flow is generally directed towards the first vertical chamber panel member 115. Meanwhile, the second heat exchange medium flow directed towards the first planar surface established by the second medium directing panel member 140, travel longitudinally within the chamber 190, while simultaneously moving vertically downwardly following the surface of the first planar surface established by the second medium directing panel member 140, generally directing the second heat exchange medium towards the second vertical chamber panel member 120.

The second heat exchange medium directed towards the first planar surface of the first medium directing panel member 135 is eventually further directed to impact the first vertical chamber panel member 115, a conduit for heat transfer means provided by the chamber assembly 105. The act of directing heat exchange medium flow to a static planar surface is generally known in the act to enhance heat transfer effectiveness by inducing mixing and agitating effect to the heat exchange, which generally results in improved heat convection effects. The second heat exchange medium directed towards the first planar surface of the second medium directing panel member 140 is similarly further directed to impact the second vertical chamber panel member 120, similarly having favorable mixing and agitating effect to the second heat exchange medium.

Referring now to FIGS. 2, 4, and 5, the first medium directing panel member 135 and the second medium directing panel member 140 each respectively feature a tapered planar surface wherein the lateral width towards the first longitudinal end of respective panels are generally wider than the lateral width of the respective panels on the second longitudinal end. As shown in an embodiment of the present invention, a lateral spacing provided between the first lateral side of the respective medium directing panels and the first lateral chamber panel member 125 generally increases towards the second longitudinal end of the respective panels. The space formed between the first lateral chamber panel member 125 and the first lateral edge of the first medium directing panel member 135 forms a first upper lateral medium directing passageway 150, a fluid passageway permitting the flow of the second heat exchange medium therethrough. In a similar fashion, the space formed between the first lateral chamber panel member 125 and the first lateral edge of the second medium directing panel member 140 forms a first lower lateral medium directing passageway 160, a fluid passageway permitting the flow of the second heat exchange medium therethrough.

The lateral spacing provided on a second lateral side respectively of the first medium directing panel member 135 and the second medium directing panel member 140 similarly increases towards the second longitudinal end of the respective panels as shown in an embodiment of the present invention in FIG. 2. The space formed between the second lateral chamber panel member 130 and the second lateral edge of the first medium directing panel member 135 forms a second upper lateral medium directing passageway 155, a fluid passageway permitting the flow of the second heat exchange medium therethrough. The space formed between the second lateral chamber panel member 130 and the second lateral edge of the second medium directing panel member 140 forms a second lower lateral medium directing passageway 165, a fluid passageway permitting the flow of the second heat exchange medium therethrough.

The flow of the second heat exchange medium diverted towards the first planar surface of the first medium directing panel member 135 within the chamber 190 generally travel longitudinally following the surface of the first planar surface of the first medium directing panel member 135, while vertically directed towards the first vertical chamber panel member 115. As the second heat exchange medium travels further longitudinally within the chamber 190 following the surface of the first planar surface of the first medium directing panel member 135, the flow of the second heat exchange medium is simultaneously diverted into two semicircular divergent lateral flow paths as the second longitudinal end of the first medium directing panel member 135 generally engages the first vertical chamber panel member 115, thereby restricting further longitudinal movement of the second heat exchange medium in an embodiment of the present invention.

As a result, a portion of the second heat exchange medium diverted towards the first medium directing panel member 135 is further directed to flow towards the first upper lateral medium directing passageway 150, while generally the remainder of the second heat exchange medium is diverted towards the second upper lateral medium directing passageway 155. The flow of the second heat exchange medium diverted to flow towards the first upper lateral medium directing passageway 150 and towards the second upper lateral medium directing passageway 155 each generally flows in a longitudinally extended arcuate fashion, generally in a divergent lateral direction (See FIG. 1). The longitudinally extended arcuate flow of the second heat exchange medium directed towards the first upper lateral medium directing passageway 150 generally crests around the first lateral edge of the first medium directing panel member 135, while the longitudinally extended arcuate flow directed towards the second upper lateral medium directing passageway 155 generally crests around the second lateral edge of the first medium directing panel member 135.

The flow directional changes afforded by the diversion of the second heat exchange medium into two arcuate lateral flows generally provide desirable mixing and agitating effect to the second heat exchange medium, which generally provides desirable effects of enhancing heat transfer efficiency known in the art. Furthermore, the flow directional changes provide agitating effect by first directing a portion of the second heat exchange medium towards a planar surface provided by the chamber assembly 105 in the form of the first lateral chamber panel member 125 as the second heat exchange medium flow is diverted to the first upper lateral medium directing passageway 150, while the remainder of the second heat exchange medium is directed towards the planar surface provided by the second lateral chamber panel member 130 as the second heat exchange medium flow is diverted to the second upper lateral medium directing passageway 155, directly impacting the respective flow of the second heat exchange medium into a conduit for heat transfer provided by the heat exchanger 100 in the form of the first lateral chamber panel member 125 and the second lateral chamber panel member 130, generally known in the art to improve heat transfer efficiency by agitating the established heat exchange medium flow by directing the heat exchange medium flow directly into static heat conducting surfaces.

The respective flow of the second heat exchange medium directed towards the first upper lateral medium directing passageway 150 and the second upper lateral medium directing passageway 155 continues its longitudinally extended arcuate flow once cresting over the first lateral edge of the first medium directing panel member 135 and the second lateral edge of the first medium directing panel member 135, respectively.

Now referring to FIGS. 1 and 2, the flow of the second heat exchange medium diverted towards the first planar surface of the second medium directing panel member 140 within the chamber 190 generally similarly travel longitudinally following the surface of the first planar surface of the second medium directing panel member 140, while vertically generally directed towards the second vertical chamber panel member 120. As the second heat exchange medium further travels longitudinally within the chamber 190 following the surface of the first planar surface of the second medium directing panel member 140, the flow of the second heat exchange medium is simultaneously diverted into two semi-circular divergent lateral flow paths as the second longitudinal end of the second medium directing panel member 140 generally engages the second vertical chamber panel member 120, thereby restricting further longitudinal movement of the second heat exchange medium in an embodiment of the present invention.

As a result, a portion of the second heat exchange medium flow diverted towards the first planar surface of the second medium directing panel member 140 is further diverted towards the first lower lateral medium directing passageway 160, while generally the remainder of the second heat exchange medium is diverted towards the second lower lateral medium directing passageway 165. The second heat exchange medium diverted to flow towards the first lower lateral medium directing passageway 160 and towards the second lower lateral medium directing passageway 165 each generally flows in a longitudinally extended arcuate fashion, generally in a divergent lateral direction (See FIGS. 1 and 3). The longitudinally extended arcuate flow directed towards the first lower lateral medium directing passageway 160 generally crests around the first lateral edge of the second medium directing panel member 140, while the longitudinally extended arcuate flow directed towards the second lower lateral medium directing passageway 165 generally crests around the second lateral edge of the second medium directing panel member 140.

The directional flow changes afforded by the diversion of the second heat exchange medium into two arcuate lateral flows generally provide desirable mixing and agitating effect to the second heat exchange medium, which generally provides desirable effects of enhancing heat transfer efficiency known in the art. Furthermore, the flow directional changes provide agitating effect by first directing a portion of the second heat exchange medium towards a planar surface provided by chamber assembly 105 in the form of the first lateral chamber panel member 125 as the second heat exchange medium flow is diverted to the first lower lateral medium directing passageway 160, while the remainder of the second heat exchange medium is directed towards the planar surface provided by the second lateral chamber panel member 130 as the second heat exchange medium flow is diverted to the second lower lateral medium directing passageway 165, directly impacting the respective flow of the second heat exchange medium into a conduit for heat transfer provided by the heat exchanger 100 in the form of the first lateral chamber panel member 125 and the second lateral chamber panel member 130, generally known in the art to improve heat transfer efficiency by agitating the established heat exchange medium flow by directing flow of heat exchange medium to a static planar surface provided for heat conducting purposes.

The flow of the second heat exchange medium directed towards the first lower lateral medium directing passageway 160 and the second lower lateral medium directing passageway 165 each respectively continues its longitudinally extended arcuate flow once cresting over the first lateral edge of the second medium directing panel member 140 and the second lateral edge of the second medium directing panel member 140, respectively.

Referring again to FIG. 1, the flow of the second heat exchange medium diverted towards the first upper lateral medium directing passageway 150 and the second upper lateral medium directing passageway 155 generally laterally abuts the first lateral side and the second lateral side of the first medium directing panel member 135, respectively. The respective flow of the second heat exchange medium directed towards the first upper lateral medium directing passageway 150 and the second upper lateral medium directing passageway 155, once cresting the first lateral side edge and the second lateral side edge, respectively, of the first medium directing panel member 135, generally continues its respective longitudinally extended arcuate flow within the chamber 190, towards the second planar side of the first medium directing panel member 135, wherein the two longitudinally extended arcuate flows are generally directed to collide into each other. The merging of the flow of heat exchange medium is generally known in the art to enhance heat transfer effectiveness by introducing agitating effect to the heat exchange medium, disrupting the normalized flow of the second heat exchange medium which may hamper effective heat transfer.

Now referring again to FIG. 1, the flow of the second heat exchange medium diverted towards the first lower lateral medium directing passageway 160 and the second lower lateral medium directing passageway 165 generally laterally abuts the first lateral side and the second lateral side of the second medium directing panel member 140, respectively.

The respective flow of the second heat exchange medium directed towards the first lower lateral medium directing passageway 160 and the second lower lateral medium directing passageway 165, once cresting the first lateral side edge and the second lateral side edge, respectively, of the second medium directing panel member 140, generally continues its respective longitudinally extended arcuate flow within the chamber 190, towards the second planar side of the second medium directing panel member 140, wherein the two longitudinally extended arcuate flows are generally directed to collide into each other. The merging of the flow of heat exchange medium is generally known in the art to enhance heat transfer effectiveness by introducing agitating effect to the heat exchange medium, disrupting the normalized flow of the second heat exchange medium which may hamper effective heat transfer effect.

The flow of the second heat exchange medium diverted towards the first planar surface of the first medium directing panel member 135 that has been diverted into further two distinct lateral flow directions, one towards the first upper lateral medium directing passageway 150 and the other towards the second upper lateral medium directing passageway 155, are generally directed to flow into each other on the second planar side of the first medium directing panel member 135, wherein the two separate flows are generally merged into a singular flow once again. The flow of the second heat exchange medium diverted towards the first planar surface of the second medium directing panel member 140 that has been diverted into further two distinct lateral flow directions, one towards the first lower lateral medium directing passageway 160 and the other towards the second lower lateral medium directing passageway 165, are generally directing to flow into each other on the second planar side of the second medium directing panel member 140, merging into a singular flow.

On the second planar side respectively of the first medium directing panel member 135 and the second medium directing panel member 140, the second heat exchange medium that was diverted into four distinct flow paths comprising the first upper lateral medium directing passageway 150, the second upper lateral medium directing passageway 155, the first lower lateral medium directing passageway 160, and the second lower lateral medium directing passageway 165 are generally directed to merge into generally a singular flow once again within the chamber 190. Once generally merged into a singular flow within the chamber 190, flow characteristics of the second heat exchange medium generally maintain its agitated flow state as four distinct flow streams are mixed, until eventually settling to conform to a unitary flow stream. The flow of the second heat exchange medium generally eventually conforms to the initial line of flow, generally conforming to the longitudinal axial characteristics established by the chamber assembly 105, while being directed to flow towards the chamber outlet 185. Once the second heat exchange medium reaches the chamber outlet 185, the second heat exchange medium is then discharged out of the chamber 190, thereby discharged out of the heat exchanger 100 by extension.

In an embodiment of the present invention, a plurality of heat exchanger 100 may be coupled together to form a larger heat exchange assembly to facilitate greater heat transfer performance. As the material forming the chamber assembly 105 generally facilitate as a conduit to transfer heat between the first heat exchange medium and the second heat exchange medium, the greater the number of chamber assembly 105 bundled together to form a heat exchanger assembly, generally results in greater heat transfer capacity.

Figure 17:
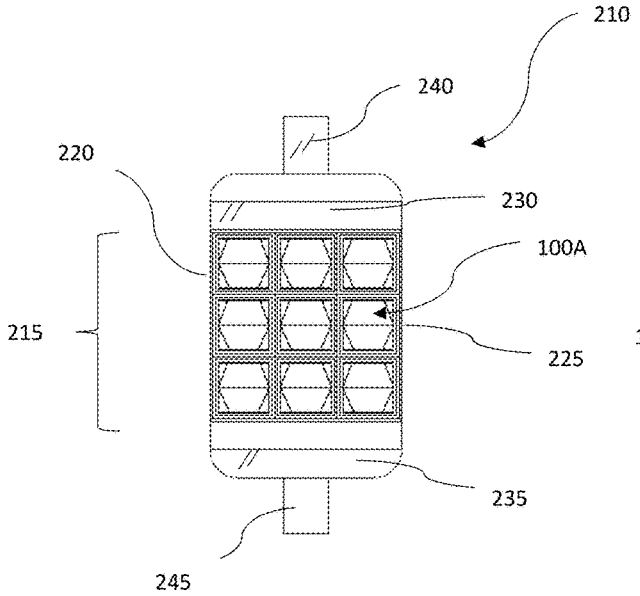
FIG. 17 is a frontal view of a heat exchanger assembly according to an embodiment of the present invention.
Figure 18:
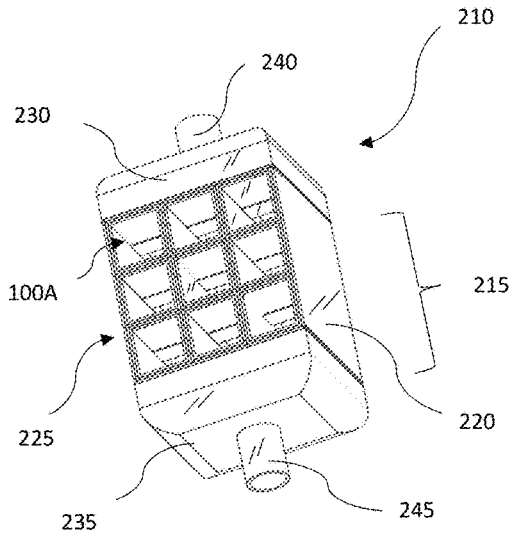
FIG. 18 is a backward perspective view of a heat exchanger assembly according to an embodiment of the present invention.

Now referring to FIGS. 17 and 18, an embodiment of a heat exchanger assembly 210 is shown. The heat exchanger assembly 210 is provided with a core assembly 215, which comprises a plurality of heat exchanger 100A bundled together.

The core assembly 215 may be laterally bound on a first lateral side by a first core lateral wall 220 and on a second lateral side by a second core lateral wall 225, establishing a first and a second lateral side of the heat exchanger assembly 210. The first core lateral wall 220 and the second core lateral wall 225 may each individually be a generally planar panel member having a thickness. On the vertical sides of the core assembly 215, the core assembly 215 may be vertically bound by an inlet tank 230 on a first vertical side and an outlet tank 235 on a second vertical side, establishing a first and a second vertical side of the heat exchanger assembly 210. The inlet tank 230 and the outlet tank 235 may each individually be a hollow member, capable of containing the first heat exchange medium therein for the desired effect. A first longitudinal end of the core assembly 215 generally establishes the frontal plane of the heat exchanger assembly 210, while a second longitudinal end of the core assembly 215 generally establishes the backward plane of the heat exchanger assembly 210.

The first longitudinal end and the second longitudinal end of the core assembly 215, along with the first core lateral wall 220, the second core lateral wall 225, the inlet tank 230, and the outlet tank 235 form a fluid containing vessel, a vessel that may be used to contain the first heat exchange medium therein. The heat exchanger assembly 210 may be shown generally as rectangular in shape, however, in other embodiment of the present invention, the heat exchanger assembly 210 may be shaped into other geometric shapes, such as a trapezoidal shape or a cylindrical shape, for example.

Figure 19:
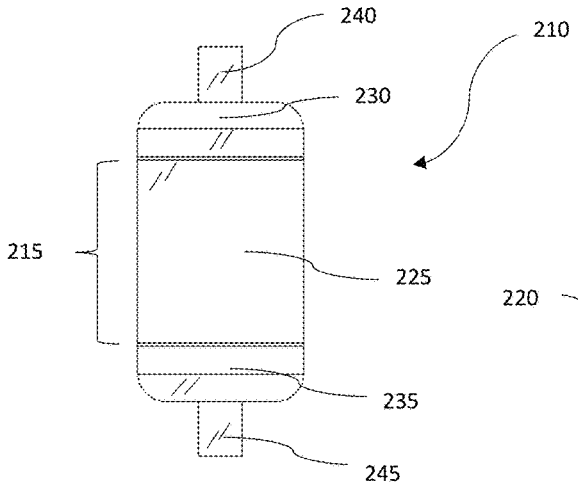
FIG. 19 is a side view of a heat exchanger assembly according to an embodiment of the present invention.
Figure 20:
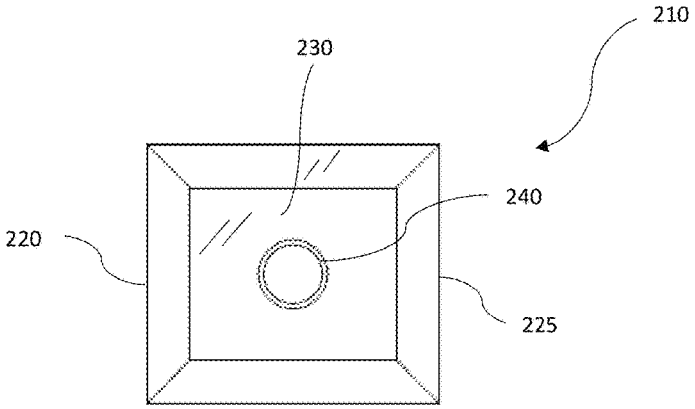
FIG. 20 is a top view of a heat exchanger assembly according to an embodiment of the present invention.

Now referencing FIGS. 19 and 20, a side view as well as a top view of the heat exchanger assembly 210 is shown. The inlet tank 230 is provided with a heat exchanger assembly inlet 240, a generally hollow tubular member having a first end extending away from the inlet tank 230, while a second end showed coupled to the inlet tank 230. The heat exchanger assembly inlet 240 is fluidly connected to the inlet tank 230, thereby providing means to introduce the first heat exchange medium into the heat exchanger assembly 210. The heat exchanger assembly inlet 240 may be shown as generally cylindrical in shape, however, it may be shaped into other geometric shapes such as a rectangular parallelepiped, for example.

Referring now to FIG. 19, the outlet tank 235 may be provided with a heat exchanger assembly outlet 245, a generally hollow tubular member having a first end extending away from the outlet tank 235 and a second end coupled to the outlet tank 235. The heat exchanger assembly outlet 245 and the outlet tank 235 may be fluidly connected to each other, thereby providing means to discharge the first heat exchange medium out of the heat exchanger assembly 210. The heat exchanger assembly outlet 245 may be shown as generally cylindrical in shape, however, it may be shaped into other geometric shapes such as a rectangular parallelepiped, for example. In an embodiment of the present invention, the first heat exchange medium may be recirculated as part of a cooling loop or a heat source, dependent upon the application of the heat exchanger assembly 210.

Referring again to FIG. 19, in an embodiment of the present invention, the heat exchanger assembly inlet 240 and the heat exchanger assembly outlet 245 may be generally located at an opposite vertical end of the heat exchanger assembly 210. The heat exchanger assembly inlet 240 may be shown located at the top vertical side of the heat exchanger assembly 210, while the heat exchanger assembly outlet 245 may be shown located at the bottom vertical side of the heat exchanger assembly 210. Such locating means of the heat exchanger assembly inlet 240 and the heat exchanger assembly outlet 245 may permit the uniform flow of the first heat exchange medium once introduced into the heat exchanger assembly 210. However, in other embodiment of the present invention (Not shown), the heat exchanger assembly inlet 240 and the heat exchanger assembly outlet 245 may be located on the first lateral side of the heat exchanger assembly 210 and the second lateral side of the heat exchanger assembly 210, respectively, for example. Furthermore, although the heat exchanger assembly inlet 240 and the heat exchanger assembly outlet 245 may be shown generally vertically aligned to each other, in other embodiment of the present invention, the heat exchanger assembly inlet 240 and the heat exchanger assembly outlet 245 may not be vertically aligned to each other (Not shown) to obtain a different desired effect.

In other embodiment of the present invention, the use of the inlet tank 230 may be combined with use of an inlet distribution plate (Not shown), a generally planar panel member having a thickness with a plurality of orifices extending therethrough, disposed between the inlet tank 230 and the core assembly 215, for further control of distribution of the first heat exchange medium into the heat exchanger assembly 210. Similarly, the use of the outlet tank 235 may be combined with use of an outlet distribution plate (Not shown), a generally planar panel member having a thickness with a plurality of orifices extending therethrough, disposed between the outlet tank 235 and the core assembly 215, for a desired effect of providing further control of the distribution of the first heat exchange medium within the heat exchanger assembly 210.

In other embodiment of the present invention, the plurality of chamber inlet 180 provided by the heat exchanger assembly 210 may be coupled to a tank assembly (Not shown) to introduce the second heat exchange medium into the heat exchanger assembly 210 from a container device coupled to the heat exchanger assembly 210. In a similar fashion, the plurality of chamber outlet 185 provided by the heat exchanger assembly 210 may also be coupled to another tank assembly (Not shown) to discharge the second heat exchange medium from the heat exchanger assembly 210 into a container device in the form of a tank assembly. In an embodiment of the present invention, one or more tank devices may be utilized to introduce and then to discharge the second heat exchange medium out of the heat exchanger assembly 210. In such an embodiment of the present invention, the second heat exchange medium may be recirculated as part of a cooling loop or a heat source, for example.

Figure 6:
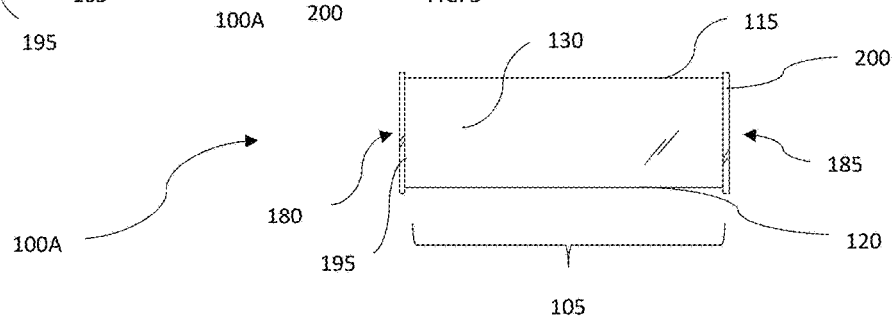
FIG. 6 is a side view of a heat exchanger according to an embodiment of the present invention.

Reference is now made to FIGS. 4, 5 and 6, where the embodiment of the heat exchanger 100A is shown. The plurality of heat exchanger 100A is generally combined into the core assembly 215, to generally form a larger capacity heat exchanger assembly 210. Although the heat exchanger 100A may be utilized as a heat exchanger by itself, in order to facilitate a greater amount of heat transfer, it may be desirable to expand the surface area available for heat transfer purposes by combining the plurality of heat exchanger 100A together to form a larger core assembly 215, multiplying heat transfer surfaces greatly over a single heat exchanger 100A, significantly increasing the heat transfer capacity of the heat exchanger assembly 210.

Figure 7:
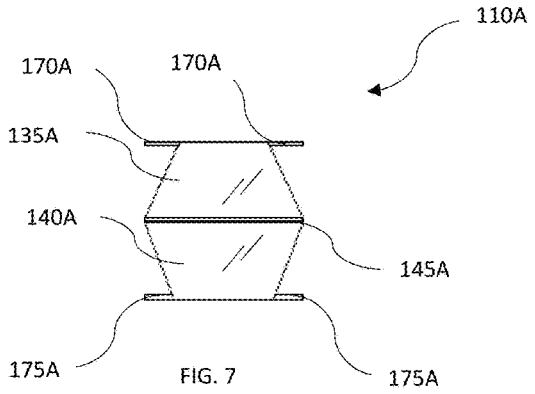
FIG. 7 is a frontal view of a medium directing assembly according to an embodiment of the present invention.
Figure 8:
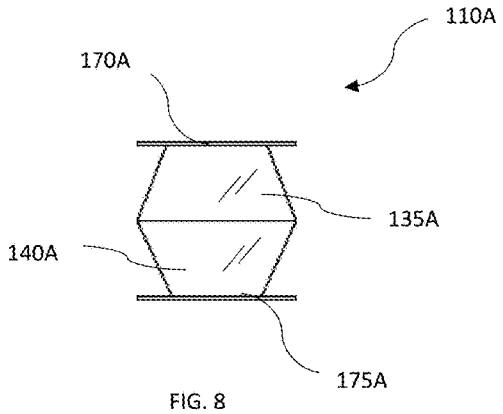
FIG. 8 is a back view of a medium directing assembly according to an embodiment of the present invention.

Now reference is made to FIGS. 7 and 8, where another embodiment of a medium directing assembly 110A is shown. The medium directing assembly 110A is provided with two generally planar panel members comprising a first medium directing panel member 135A and a second medium directing panel member 140A. The first medium directing panel member 135A and the second medium directing panel member 140A are each provided with a first planar surface and a second planar surface, wherein the second planar surface of respective medium directing panel members are generally located on the opposite side of the first planar surface. The medium directing panel member 135A and the second medium directing panel member 140A are each positioned at an angle, wherein a first longitudinal end respectively of the first medium directing panel member 135A and the second medium directing panel member 140A engages each other, while a second longitudinal end of the first medium directing panel member 135A and the second medium directing panel member 140A are positioned spaced apart. The first planar surface of the first medium directing panel member 135A and the second medium directing panel member 140A are further angled so that the respective first planar surfaces are positioned at an angle relative to the longitudinal axial characteristics established by the chamber assembly 105, once the medium directing assembly 110A is coupled inside the chamber assembly 105.

Figure 9:
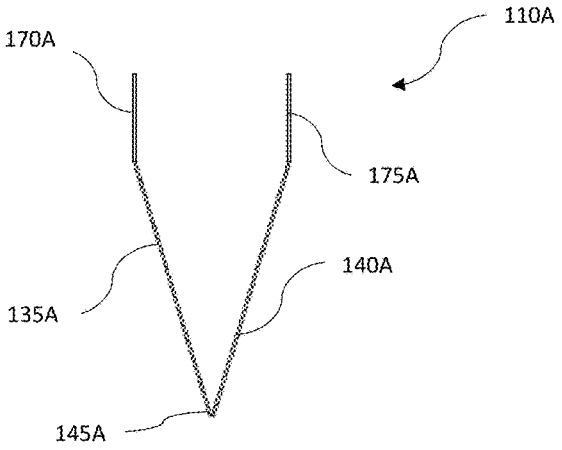
FIG. 9 is a side view of a medium directing assembly according to an embodiment of the present invention.
Figure 10:
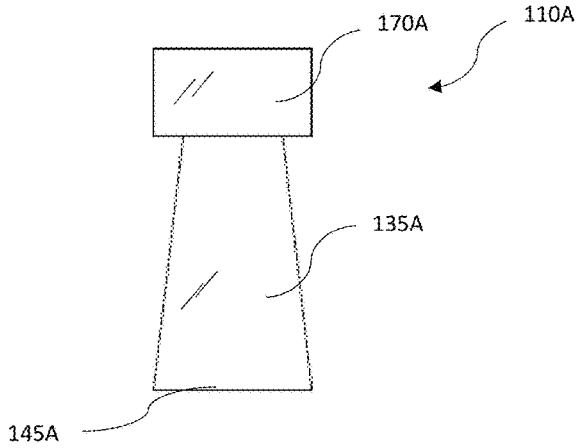
FIG. 10 is a top view of a medium directing assembly according to an embodiment of the present invention.

Referring again to FIGS. 7 and 8, a first lateral edge and a second lateral edge, respectively, of the first medium directing panel member 135A and the second medium directing panel member 140A are angled inwardly as the respective medium directing panel members extend longitudinally, thereby providing laterally wider first longitudinal end than the second longitudinal end of the respective medium directing panel members. Now referring to FIGS. 9 and 10, on the second longitudinal end of the first medium directing panel member 135A, an upper mating panel member 170A is coupled. The upper mating panel member 170A is a generally planar panel member having a thickness, having a first planar surface and a second planar surface. When the medium directing assembly 110A is coupled inside the chamber assembly 105, the first planar surface of the upper mating panel member 170A engages the interior surface of the chamber assembly 105, thereby providing additional heat conducting surface between the chamber assembly 105 and the medium directing assembly 110A, generally enhancing the overall heat transfer effectiveness of the heat exchanger 100.

Referring again to FIGS. 9 and 10, on the second longitudinal end of the second medium directing panel member 140A, a lower mating panel member 175A is coupled. The lower mating panel member 175A is a generally planar panel member having a thickness, having a first planar surface and a second planar surface. When the medium directing assembly 110A is coupled inside the chamber assembly 105, the first planar surface of the lower mating panel member 175A engages the interior surface of the chamber assembly 105, thereby providing additional heat conducting surface between the chamber assembly 105 and the medium directing assembly 110A, generally enhancing the overall heat transfer effectiveness of the heat exchanger 100.

Figure 11:
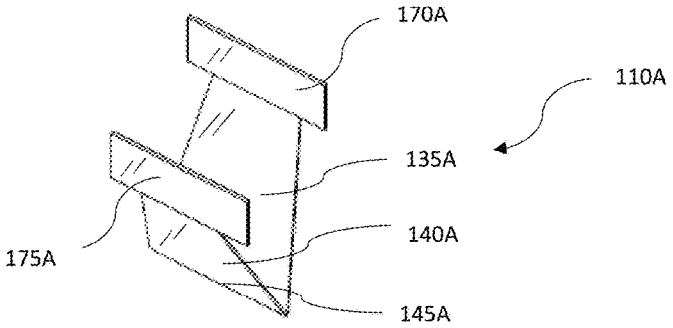
FIG. 11 is a bottom perspective view of a medium directing assembly according to an embodiment of the present invention.

Referring now to FIG. 11, the upper mating panel member 170A and the lower mating panel member 175A are generally shown to be rectangular in shape. However, in other embodiment of the present invention, the respective panel members may be in other geometric shapes, such as a square, an oval, or a circle, for example. Furthermore, although an embodiment of the respective panel members is generally shown to be plain surfaced panel members, in other embodiment of the present invention, respective panel members may feature surface enhancements, such as louvers, protrusions, or indentations, for example, for the desired effect.

Figure 12:
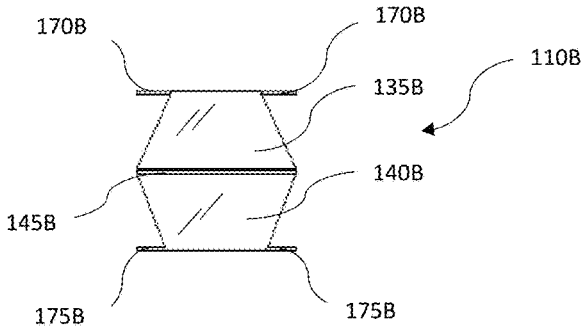
FIG. 12 is a frontal view of a medium directing assembly according to another embodiment of the present invention.
Figure 13:
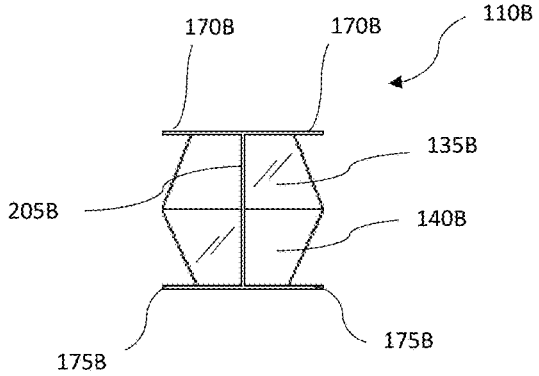
FIG. 13 is a back view of a medium directing assembly according to another embodiment of the present invention.

Now reference is made to FIGS. 12 and 13, where yet another embodiment of a medium directing assembly 110 is shown. The medium directing assembly 110B is provided with two generally planar panel members comprising a first medium directing panel member 135B and a second medium directing panel member 140B. The first medium directing panel member 135B and the second medium directing panel member 140B are each provided with a first planar surface and a second planar surface, wherein the second planar surface of respective panel members is generally located on the opposite side of the first planar surface. The first medium directing panel member 135B and the second medium directing panel member 140B are each positioned at an angle, wherein a first longitudinal end respectively of the first medium directing panel member 135B and the second medium directing panel member 140B engages each other, while a second longitudinal end of the first medium directing panel member 135B and the second medium directing panel member 140B are positioned spaced apart. The first planar surface of the first medium directing panel member 135B and the second medium directing panel member 140B are further angled so that the respective first planar surfaces are positioned at an angle relative to the longitudinal axial characteristics established by the chamber assembly 105, once the medium directing assembly 110B is coupled inside the chamber assembly 105.

Figure 14:
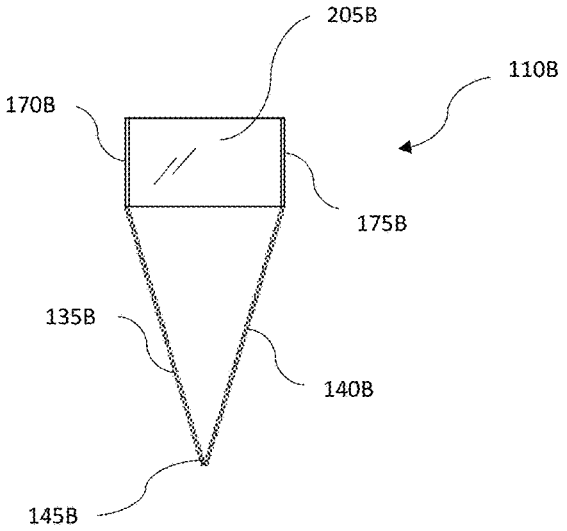
FIG. 14 is a side view of a medium directing assembly according to another embodiment of the present invention.
Figure 15:
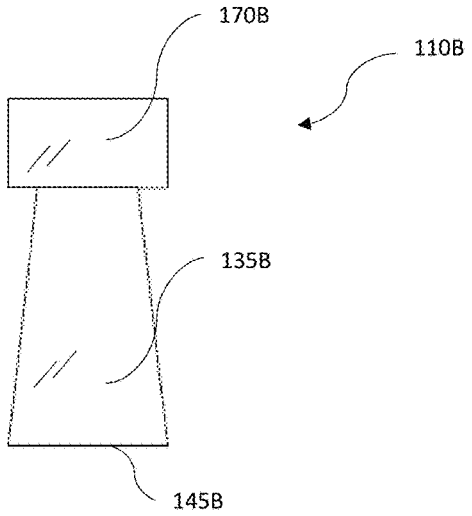
FIG. 15 is a top view of a medium directing assembly according to another embodiment of the present invention.

Referring again to FIGS. 12 and 13, a first lateral edge and a second lateral edge, respectively, of the first medium directing panel member 135B and the second medium directing panel member 140B are angled inwardly as respective medium directing panel members extend longitudinally, thereby providing laterally wider first longitudinal end than the second longitudinal end of the respective medium directing panel members. Now referring to FIGS. 14 and 15, on the second longitudinal end of the first medium directing panel member 135B, an upper mating panel member 170B is coupled. The upper mating panel member 170B is a generally planar panel member having a thickness. The upper mating panel member 170B is generally provided with a first planar surface and a second planar surface. When the medium directing assembly 110B is coupled inside the chamber assembly 105, the first planar surface of the upper mating panel member 170B engages the interior surface of the chamber assembly 105, thereby providing additional heat conducting surface between the chamber assembly 105 and the medium directing assembly 110B, generally enhancing the overall heat transfer effectiveness of the heat exchanger 100.

Referring again to FIGS. 14 and 15, on the second longitudinal end of the second medium directing panel member 140B, a lower mating panel member 175B is coupled. The lower mating panel member 175B is a generally planar panel member having a thickness. The lower mating panel member 175B is generally provided with a first planar surface and a second planar surface. When the medium directing assembly 110B is coupled inside the chamber assembly 105, the first planar surface of the lower mating panel member 175B engages the interior surface of the chamber assembly 105, thereby providing additional heat conducting surface between the chamber assembly 105 and the medium directing assembly 110B, generally enhancing the overall heat transfer effectiveness of the heat exchanger 100.

Figure 16:
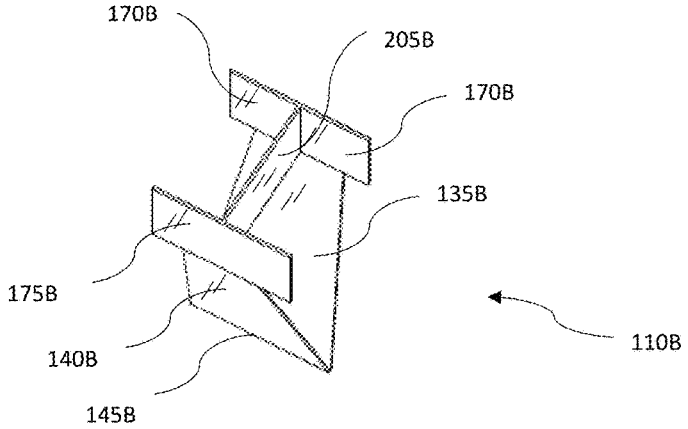
FIG. 16 is a bottom perspective view of a medium directing assembly according to another embodiment of the present invention.

Referring now to FIG. 16, disposed between the upper mating panel member 170B and the lower mating panel member 175B is a distribution support member 205B. The distribution support member 205B is generally a planar panel member having a thickness. The distribution support member 205B is generally disposed between the upper mating panel member 170B and the lower mating panel member 175B, wherein a first vertical edge of the distribution support member 205B engages the upper mating panel member 170B, while a second vertical edge of the distribution support member 205B engages the lower mating panel member 175B. The distribution support member 205B is generally provided with a first planar surface and a second planar surface, wherein the second planar surface is located generally on the opposite side of the first planar surface. The first planar surface and the second planar surface of the distribution support member 205B are generally positioned transversely relative to the planes established by the first planar surface and the second planar surface, respectively, of the upper mating panel member 170B and the lower mating panel member 175B.

A first longitudinal edge of the distribution support member 205B faces towards the first longitudinal end of the medium directing assembly 110B, while a second longitudinal edge of the distribution support member 205B faces towards the second longitudinal end of the medium directing assembly 110B. The first planar surface and the second planar surface of the distribution support member 205B provides heat transfer surfaces, wherein the second heat exchange medium diverted towards the first lateral edge respectively of the first medium directing panel member 135B and the second medium directing panel member 140B are directed towards the first planar surface of the distribution support member 205B, while the second heat exchange medium diverted towards the second lateral edge respectively of the first medium directing panel member 135B and the second medium directing panel member 140B are directed towards the second planar surface of the distribution support member 205B. The action of directing the flow of heat exchange medium towards a static heat transfer surface is generally known in the art to improving heat transfer effectiveness, by introducing swirling and mixing action to the heat transfer medium thereby enhancing heat convection.

In an embodiment of the present invention, the upper mating panel member 170B and the lower mating panel member 175B are generally shown to be rectangular in shape. However, in other embodiment of the present invention, the respective panels may be in other geometric shapes, such as a square, an oval, or a circle, for example. Furthermore, the embodiment of the respective panel members may be shown generally to be plain surfaced panel members. In other embodiment of the present invention, however, respective panel members may feature surface enhancements known in the art, such as louvers, protrusions, or indentations, for example, for the desired effect.

In an embodiment of the present invention, the distribution support member 205B may be shown generally rectangular in shape. However, in other embodiment of the present invention, the distribution support member 205B may be shaped into other geometric shapes, such as an oval, trapezoidal, or square, for example. In an embodiment of the present invention, the longitudinal span of the distribution support member 205B may be shown generally similar to the longitudinal span of the upper mating panel member 170B and the lower mating panel member 175B. However, in other embodiment of the present invention, the longitudinal span of the distribution support member 205B may be longer or shorter than the longitudinal span of the upper mating panel member 170B as well as the longitudinal span of the lower mating panel member 175B, for example.

Referring now to FIG. 6, the plurality of heat exchanger 100A may be coupled together while facilitating means of providing passageways for the first heat transfer medium to flow around the outer surface of the individual heat exchanger 100A coupled within the heat exchanger assembly 210. In an embodiment of the heat exchanger 100A, a first longitudinal spacing member 195 may be provided on a first longitudinal end of the plurality of heat exchanger 100A, while a second longitudinal spacing member 200 may be provided on a second longitudinal end of the plurality of heat exchanger 100A to obtain a desirable vertical and horizontal spacing arrangement between the plurality of heat exchanger 100A that may be packaged in the heat exchanger assembly 210.

The first longitudinal spacing member 195 and the second longitudinal spacing member 200 are each generally a planar panel member having a thickness, extending outwardly away generally in a perpendicular fashion from the outer planar surface established by the generally rectangular parallelepiped chamber assembly 105 of the heat exchanger 100A, generally comprising the first vertical chamber panel member 115, the second vertical chamber panel member 120, the first lateral chamber pane member 125, and the second lateral chamber panel member 130. A first vertical edge respectively of the first longitudinal spacing member 195 and the second longitudinal spacing member 200 extend outwardly away from the exterior planar surface established by the first vertical chamber panel member 115, while a second vertical edge respectively of the first longitudinal spacing member 195 and the second longitudinal spacing member 200 extend away from the exterior planar surface established by the second vertical chamber panel member 120. In a similar fashion, a first lateral edge respectively of the first longitudinal spacing member 195 and the second longitudinal spacing member 200 extend away from the exterior planar surface established by the first lateral chamber panel member 125, while a second lateral edge respectively of the first longitudinal spacing member 195 and the second longitudinal spacing member 200 extend away from the exterior planar surface established by the second lateral chamber panel member 130.

In an embodiment of the present invention, the second lateral edge of the first longitudinal spacing member 195 and the second longitudinal spacing member 200 provided by a first heat exchanger 100A may engage the first lateral edge of the first longitudinal spacing member 195 and the second longitudinal spacing member 200 provided by a second heat exchanger 100A, thereby forming a vertical passageway 250 permitting flow of the first heat exchange medium therebetween. The second lateral edge of the first longitudinal spacing member 195 and the second longitudinal spacing member 200 provided by the first heat exchanger 100A may be extended or shorted to obtain the desired spacing arrangement between the first heat exchanger 100A and the second heat exchanger 100A that may be positioned laterally adjacent to each other, to allow for desired flow of the first heat exchange medium between the first heat exchanger 100A and the second heat exchanger 100A. In a similar fashion, the first lateral edge of the first longitudinal spacing member 195 and the second longitudinal spacing member 200 provided by the second heat exchanger 100A may be extended or shorted to obtain the desired spacing between the first heat exchanger 100A and the second heat exchanger 100A to allow for desired flow of the first heat exchange medium around the plurality of heat exchanger 100A.

Further in an embodiment of the present invention, when the first heat exchanger 100A is positioned located vertically adjacent to the second heat exchanger 100A, the second vertical edge of the first longitudinal spacing member 195 and the second longitudinal spacing member 200 provided by the first heat exchanger 100A may engage the first vertical edge of the first longitudinal spacing member 195 and the second longitudinal spacing member 200 provided by the second heat exchanger 100A to form a horizontal passageway 255, permitting flow of the first heat exchange medium therebetween. The second vertical edge of the first longitudinal spacing member 195 and the second longitudinal spacing member 200 provided by the first heat exchanger 100A may be extended or shorted to obtain the desired spacing between the first heat exchanger 100A and the second heat exchanger 100A for desired flow of the first heat exchange medium between the first heat exchanger 100A and the second heat exchanger 100A. In a similar fashion, the first vertical edge of the first longitudinal spacing member 195 and the second longitudinal spacing member 200 provided by the second heat exchanger 100A may be extended or shorted to obtain a desired spacing arrangement for flow of the first heat exchange medium between the first heat exchanger 100A and the second heat exchanger 100A.

Now reference is made to FIGS. 17 and 18, where a frontal and a perspective view of the heat exchanger assembly 210 is shown. In an embodiment of the present invention shown in FIG. 17, the plurality of heat exchanger 100A may be shown vertically and horizontally aligned, thereby forming a plurality of the horizontal passageway 255 and the vertical passageways 250 surrounding the plurality of heat exchanger 100A that may extend in a straight line from one end of the heat exchanger assembly 210 to the opposing end (See also FIG. 21). However, in other embodiment of the present invention, the plurality of heat exchanger 100A may be coupled within the heat exchanger assembly 210 in a staggered fashion, thereby having the plurality of passageways for the first heat exchange medium segmented into a plurality of vertical fluid passageways 250A and horizontal fluid passageways 255A, arranged in a staggered fashion within a core assembly 215A. In such an embodiment of the present invention, now referring FIG. 22, the predetermined segmented vertical fluid passageway 250A may be directed towards the heat exchanger 100A for the desired effect, facilitating the arrangement of a desired staggered arrangement of the vertical fluid passageway. To achieve such a result, the heat exchanger 100A of various lateral widths may be combined in the core assembly 215A, for example. A laterally narrower heat exchanger 100A may be combined with a laterally wider heat exchanger 100A to obtain the desired staggering effect of the vertical fluid passageway 250A. The staggering effect may be generally uniform in shape and arrangement. However, in other embodiment of the present invention, the staggering pattern may not be uniform.

Figure 21:
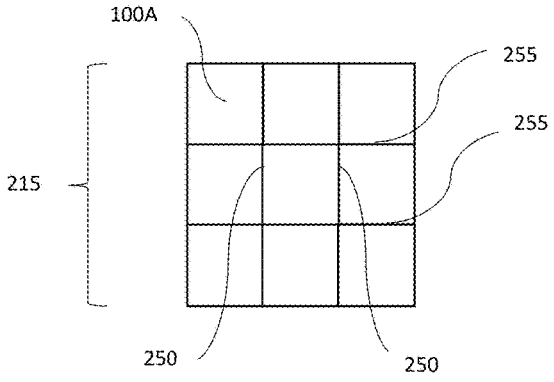
FIG. 21 is a schematic frontal view of a core assembly, according to an embodiment of the present invention.
Figure 22:
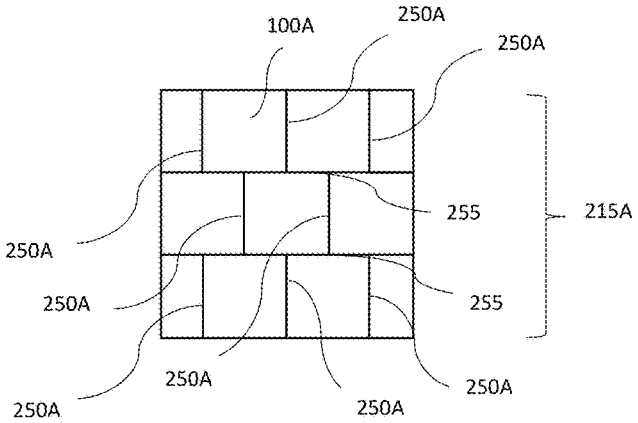
FIG. 22 is a schematic frontal view of a core assembly, according to another embodiment of the present invention.
Figure 23:
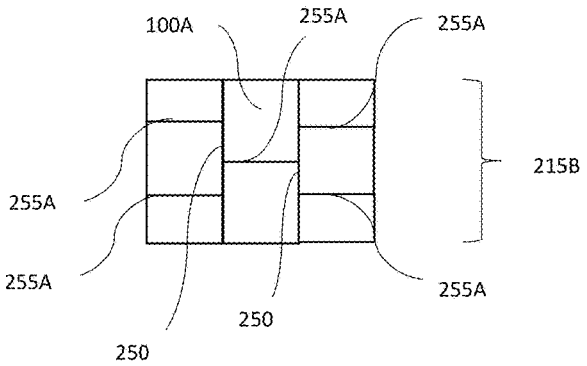
FIG. 23 is a schematic frontal view of a core assembly, according to yet another embodiment of the present invention.

In an embodiment of the present invention, the plurality of horizontal fluid passageway 255 may be shown to be arranged to extend laterally from the first lateral side to the second lateral side of the heat exchanger assembly 210 (See FIG. 21). However, in other embodiment of the present invention, now referencing FIG. 23, the horizontal fluid passageway 255A may be featured with a plurality of segmented sections, arranged in a staggered effect by combining the heat exchanger 100A of various vertical height to obtain the desired effect to the flow of the first heat exchange medium within a core assembly 215B. The horizontal fluid passageway may be parallel in relation to the vertical planes established by the exterior vertical surface of the heat exchanger assembly 210. However, in other embodiment of the present invention, the horizontal fluid passageway 255 may not be parallel to the vertical planes established by the heat exchanger assembly 210.

Referring again to FIG. 3, in an embodiment of the present invention, the heat exchanger 100 may be shown as having one chamber assembly 105. However, in other embodiment of the present invention, a plurality of chamber assembly 105 may be combined longitudinally in a serial matter, end to end, for the desired effect. In such an embodiment of the present invention, the quantity of the medium directing assembly 110 may increase according to the quantity of the chamber assembly 105 coupled together as an assembly. Furthermore, as the plurality of chamber assembly 105 is combined together to form a larger assembly, the flow pattern of the second heat exchange medium described herein may be repeated several times within the assembly dependent upon the number of the chamber assembly 105 and the medium directing assembly 110 that may be packaged in the assembly.

In an embodiment of the present invention, the chamber inlet 180 and the chamber outlet 185 may be generally similar in shape. However, in other embodiment of the present invention, the chamber inlet 180 and the chamber outlet 185 may be of a dissimilar shape, wherein the chamber inlet 180 may be square in shape whereas the chamber outlet 185 may be circular shaped, for example. In such an embodiment of the present invention, the shape of the chamber assembly 105 may be formed to accommodate the dissimilar shape of the chamber inlet 180 and the chamber outlet 185, for example. In a similar fashion, the first medium directing panel member 135 and the second medium directing panel member 140 may be shown as generally similarly shaped. However, in other embodiment of the present invention, the first medium directing panel member 135 and the second medium directing panel member 140 may be dissimilar in shape, size, as well as in angulation and configuration, for example.

The heat exchanger 100 may be utilized as a cooler, a condenser, an evaporator, a radiator, an oil cooler or any other application requiring heat to be transferred from one heat exchange medium to another heat exchange medium. The heat exchanger 100 may be for use in various heat exchange applications, such as in automotive, industrial, commercial, or consumer electronics and appliance applications, for example, where packaging space provided for the heat exchanger may be generally limited or where the reduction in weight of the heat exchanger is desired. The first heat exchange medium, as well as the second heat exchange medium, may be air, liquid, or gas, known in the art. In an embodiment of the present invention, more than one type of heat exchange medium may be utilized. Furthermore, in some embodiments of the present invention, the first heat exchange medium, as well as the second heat exchange medium, may be combined with more than one type of material, such as with the use of air and silica gel solids to obtain additional desired features, for example. Similarly, the heat exchanger assembly 210 may be utilized as a cooler, a condenser, an evaporator, a radiator, an oil cooler or any other application requiring heat to be transferred from one heat exchange medium to another heat exchange medium. The heat exchanger assembly 210 may be for use in various heat exchange applications, such as in automotive, industrial, commercial, or consumer electronics and appliance applications, for example, where packaging space provided for the heat exchanger may be generally limited or where the reduction in weight of the heat exchanger is desired.

The first heat exchange medium, as well as the second heat exchange medium utilized in the heat exchanger assembly 210, may be air, liquid, or gas, known in the art. In an embodiment of the present invention, more than one type of heat exchange medium may be utilized in the heat exchanger assembly 210. Furthermore, in some embodiments of the present invention, the first heat exchange medium, as well as the second heat exchange medium, may be combined with more than one type of material, such as with air and silica gel solids to obtain additional desired features, for example.

In an embodiment of the present invention, various components comprising the heat exchanger 100 may be produced of ferrous or non-ferrous material. Similarly, the components may be made of plastics or composite materials. The various components may be produced of the same material or may be produced of dissimilar materials. Various bonding and brazing means may be utilized, which may include but not limited to adhesives, epoxy, mechanical means, or brazing and soldering, for example. In another embodiment of the present invention, various components may be welded without additional bonding material, such as in the case of laser welding. In yet another embodiment of the present invention, a portion or all the components comprising the heat exchanger 100 may be manufactured by means of 3D printing technology, known in the art. Similarly, in an embodiment of the present invention, various components comprising the heat exchanger assembly 210 may be produced of ferrous or non-ferrous material. Similarly, the components may be made of plastics or composite materials. The various components may be produced of the same material or may be produced of dissimilar materials. Various bonding and brazing means may be utilized, which may include but not limited to adhesives, epoxy, mechanical means, or brazing and soldering, for example. In another embodiment of the present invention, various components may be welded without additional bonding material, such as in the case of laser welding. In yet another embodiment of the present invention, a portion or all the components comprising the heat exchanger assembly 210 may be manufactured by means of 3D printing technology, known in the art.

In an embodiment of the present invention, the heat exchanger 100 may be shown to comprise of components generally of the same thickness. However, in other embodiment of the present invention, components of various thickness may be used to improve the heat transfer effectiveness or to increase the structural rigidity of the heat exchanger 100, for example. In yet another embodiment of the present invention, the material thickness within a particular component utilized in the heat exchanger 100 may feature varying material thickness to obtain the desired effect.

In yet another embodiment of the present invention, the flow direction described herein may be reversed. In such an embodiment of the present invention, the chamber outlet 185 may function as an inlet to introduce the second heat exchange medium into the heat exchanger 100, while the chamber inlet 180 may function as an outlet to discharge the second heat exchange medium out of the heat exchanger 100. In such an embodiment of the present invention, flow of the second heat exchange medium within the chamber 190 described herein may be similarly reversed, wherein the second heat exchange medium introduced from the chamber outlet 185 into the chamber 190 may be directed towards the second planar sides respectively of the first medium directing panel member 135 and the second medium directing panel member 140. The subsequent flow pattern around the first medium directing panel member 135 and the second medium directing panel member 140 may proceed through the first upper lateral medium directing passageway 150, the second upper lateral medium directing passageway 155, the first lower lateral medium directing passageway 160, and the second lower lateral medium directing passageway 165 until the second heat exchange medium is directed towards the first planar side respectively of the first medium directing panel member 135 and the second medium directing panel member 140, where the second heat exchange medium is then subsequently discharged out of the chamber inlet 180.

In an embodiment of the present invention, the heat exchanger 100 may feature surface enhancements, such as protrusions, indentations, louvers, fins, or other surface enhancements known in the art that may be known to enhance heat transfer effectiveness or structural rigidity. The surface enhancements made to the heat exchanger 100 may be featured on the outside surface to improve the heat transfer effectiveness of the first heat exchange medium. In other embodiment of the present invention, surface enhancements may be featured on the inside surface to improve the heat transfer effectiveness of the second heat exchange medium. In yet some other embodiment of the present invention, surface enhancements may be made to the outside surface as well as the inside surface of the heat exchanger 100 for the desired effect.

Many modifications and variations of the present invention are possible in light of the above teachings. Therefore, within the scope of the appended claims, the present invention may be practiced other than as specifically described.

What is claimed is:

1. A heat exchanger having a longitudinally extending hollow chamber assembly, the chamber assembly comprising:

a first longitudinal end;

a second longitudinal end;

a chamber inlet at the first longitudinal end;

a chamber outlet at the second longitudinal end;

a first vertical chamber panel member defining a first vertical side of the chamber assembly;

a second vertical chamber panel member defining a second vertical side of the chamber assembly;

a first lateral chamber panel member defining a first lateral side of the chamber assembly;

a second lateral chamber panel member defining a second lateral side of the chamber assembly; and a medium directing assembly disposed within, all of said panel members forming a longitudinally extending hollow chamber within the chamber assembly, a first heat exchange medium configured to flow around the exterior of the chamber assembly, the chamber inlet configured to introduce a second heat exchange medium into the chamber assembly in an initial line of flow, and the chamber outlet configured to discharge the second heat exchange medium out of the chamber assembly, the medium directing assembly having a pair of planar panels, comprising a first medium directing panel member and a second medium directing panel member, each of the medium directing panel members having;

a first planar surface generally facing at an angle the chamber inlet, and configured to receive the second heat exchange medium at said angle, a second planar surface generally facing at an angle the chamber outlet, a first lateral edge generally facing the first lateral chamber panel member, and a second lateral edge generally facing the second lateral chamber panel member, the first medium directing panel member having a first longitudinal end disposed towards the chamber inlet, and a second longitudinal end disposed towards the chamber outlet, the first longitudinal end located vertically spaced apart from the first vertical chamber panel member, and the second longitudinal end generally engaging the first vertical chamber panel member, the first lateral edge and the second lateral edge of the first medium directing panel member engaging, at the first longitudinal end, the first lateral chamber panel member and the second lateral chamber panel member, respectively, and the first lateral edge and the second lateral edge of the first medium directing panel member are spaced apart, at the second longitudinal end, from the first lateral chamber panel member and the second lateral chamber panel member, respectively, the second medium directing panel member having a first longitudinal end disposed towards the chamber inlet, and a second longitudinal end disposed towards the chamber outlet, the first longitudinal end located vertically spaced apart from the second vertical chamber panel member, and the second longitudinal end engaging the second vertical chamber panel member, the first lateral edge and the second lateral edge of the second medium directing panel member engaging, at the first longitudinal end, the first lateral chamber panel member and the second lateral chamber panel member, respectively, and the first lateral edge and the second lateral edge of the second medium directing panel member are spaced apart, at the second longitudinal end, from the first lateral chamber panel member and the second lateral chamber panel member, respectively, the second heat exchange medium introduced into the chamber assembly in the initial line of flow is diverted into two vertically divergent flows, the two vertically divergent flows comprising a first flow directed towards the first planar surface of the first medium directing panel member, and a second flow directed towards the first planar surface of the second medium directing panel member, the flow of the second heat exchange medium directed towards the first planar surface of the first medium directing panel member initially directed to flow longitudinally within the chamber assembly following the contour of the first planar surface of the first medium directing panel member, while simultaneously directed vertically towards the first vertical chamber panel member in an ascending manner, the flow of the second heat exchange medium directed towards the first planar surface of the second medium directing panel member initially directed to flow longitudinally within the chamber assembly following the contour of the first planar surface of the second medium directing panel member, while simultaneously directed vertically towards the second vertical chamber panel member in a descending manner, the first lateral edge of the first medium directing panel member set at an acute angle relative to the plane established by the first lateral chamber panel member thereby defining a first upper lateral medium directing passageway therebetween, permitting flow of the second heat exchange medium therethrough in a longitudinally extending arcuate manner, the second lateral edge of the first medium directing panel member set at an acute angle relative to the plane established by the second lateral chamber panel member thereby defining a second upper lateral medium directing passageway therebetween, permitting flow of the second heat exchange medium therethrough in a longitudinally extending arcuate manner, the flow of the second heat exchange medium directed towards the first upper lateral medium directing passageway and the second upper lateral medium directing passageway further caused to flow in a laterally divergent fashion, the first lateral edge of the second medium directing panel member set at an acute angle relative to the plane established by the first lateral chamber panel member thereby defining a first lower lateral medium directing passageway therebetween, permitting flow of the second heat exchange medium therethrough in a longitudinally extending arcuate manner, the second lateral edge of the second medium directing panel member set at an acute angle relative to the plane established by the second lateral chamber panel member thereby defining a second lower lateral medium directing passageway therebetween, permitting flow of the second heat exchange medium therethrough in a longitudinally extending arcuate manner, the flow of the second heat exchange medium directed towards the first lower lateral medium directing passageway and the second lower lateral medium directing passageway further caused to flow in a laterally divergent fashion, and the flow of the second heat exchange medium directed to flow through the first upper lateral medium directing passageway, the second upper lateral medium directing passageway, the first lower lateral medium directing passageway, and the second lower lateral medium directing passageway are caused to merge into a unitary flow stream within the chamber assembly rearward of the second planar surface respectively of the first medium directing panel member and the second medium directing panel member, prior to been discharged from the chamber outlet.

2. The heat exchanger of claim 1, wherein a plurality of heat exchangers are coupled together in a serial fashion to form a heat exchanger assembly.

3. The heat exchanger of claim 1, wherein a plurality of heat exchangers are coupled together in a parallel fashion to form a heat exchanger assembly.

4. The heat exchanger of claim 1, wherein a plurality of heat exchangers are coupled together in a serial and parallel fashion to form a heat exchanger assembly.

5. The heat exchanger of claim 3, wherein the chamber assembly further comprises a first longitudinal spacing member located towards the first longitudinal end of the chamber assembly, the first longitudinal spacing member extending away from the outer surface of the chamber assembly, and a second longitudinal spacing member located towards the second longitudinal end of the chamber assembly, the second longitudinal spacing member extending away from the outer surface of the chamber assembly, the first and second longitudinal spacing members configured to form a fluid passageway for the first heat exchange medium on the exterior surface of the chamber assembly.

6. The heat exchanger of claim 4, wherein the chamber assembly further comprises a first longitudinal spacing member located towards the first longitudinal end of the chamber assembly, the first longitudinal spacing member extending away from the outer surface of the chamber assembly, and a second longitudinal spacing member located towards the second longitudinal end of the chamber assembly, the second longitudinal spacing member extending away from the outer surface of the chamber assembly, the first and second longitudinal spacing members configured to form a fluid passageway for the first heat exchange medium on the exterior surface of the chamber assembly.

7. The heat exchanger of claim 1, wherein the medium directing assembly further comprises an upper mating panel member in the form of a planar panel member, engaging the second longitudinal end of the first medium directing panel member and the chamber assembly, and a lower mating panel member in the form of a separate planar panel member, engaging the second longitudinal end of the second medium directing panel member and the chamber assembly.

8. The heat exchanger of claim 7, further comprising a distribution support member in the form of a planar panel member, having a first planar side and a second planar side, the second planar side generally on the opposite side from the first planar side, having a first vertical edge engaging the upper mating panel member, a second vertical edge engaging the lower mating panel member, a first longitudinal edge facing the chamber inlet, and a second longitudinal edge facing the chamber outlet.

9. A heat exchanger comprising:

a longitudinally extending chamber assembly comprising a plurality of panel members defining a hollow chamber within, the chamber assembly provided with a chamber inlet configured to introduce a heat exchange medium into the chamber, and a chamber outlet configured to discharge the heat exchange medium out of the chamber, the chamber establishing an initial line of flow of the heat exchange medium introduced into the chamber assembly; and a medium directing assembly disposed within the chamber assembly, the medium directing assembly including:

a first medium directing panel member; and a second medium directing panel member, the first medium directing panel member located vertically above the second medium directing panel member, the first medium directing panel member and the second medium directing panel member each having a first planar surface oriented at an angle relative to the longitudinal axial orientation established by the chamber assembly, each of the first planar surfaces facing the chamber inlet, the first medium directing panel member and the second medium directing panel member each having a first longitudinal end disposed towards the chamber inlet, and a second longitudinal end disposed towards the chamber outlet, the first medium directing panel member and the second medium directing panel member each having the first longitudinal end positioned spaced apart from the chamber assembly and positioned towards the central axis of the chamber, and having the second longitudinal end positioned in closer proximity to the chamber assembly and positioned away from the central axis of the chamber, the first longitudinal end respectively of the first medium directing panel member and the second medium directing panel member having a width greater than a width of the remainder longitudinal span of the respective medium directing panel member, the first medium directing panel member and the second medium directing panel member each having a second planar surface on the opposite side of the first planar surface of the respective medium directing panel member, the heat exchange medium flowing in the initial line of flow being diverted into two vertically divergent flows, the two vertically divergent flows comprising a first flow directed towards the first planar surface of the first medium directing panel member, and a second flow directed towards the first planar surface of the second medium directing panel member, the heat exchange medium directed towards the first planar surface of the first medium directing panel member further diverted into two divergent lateral flows, the two divergent lateral flows comprising a first flow generally flowing in a longitudinally extending arcuate manner cresting around a first lateral edge of the first medium directing panel member, and a second flow generally flowing in a longitudinally extending arcuate manner cresting around a second lateral edge of the first medium directing panel member, the heat exchange medium directed towards the first planar surface of the second medium directing panel member further diverted into two divergent lateral flows, the two divergent lateral flows comprising a first flow generally flowing in a longitudinally extending arcuate manner cresting around a first lateral edge of the second medium directing panel member, and a second flow generally flowing in a longitudinally extending arcuate manner cresting around a second lateral edge of the second medium directing panel member, and the heat exchange medium diverted from the initial line of flow by the medium directing assembly converges into a singular flow stream within the chamber, the singular flow stream flowing conforming to the initial line of flow, prior to being discharged from the chamber outlet.

10. The heat exchanger of claim 9, wherein a plurality of heat exchangers are coupled together in a serial fashion to form a heat exchanger assembly.

11. The heat exchanger of claim 9, wherein a plurality of heat exchangers are coupled together in a parallel fashion to form a heat exchanger assembly.

12. The heat exchanger of claim 9, wherein a plurality of heat exchangers are coupled together in a serial and parallel fashion to form a heat exchanger assembly.

13. The heat exchanger of claim 11, wherein the chamber assembly further comprises a first longitudinal spacing member located towards the first longitudinal end of the chamber assembly, the first longitudinal spacing member extending away from the outer surface of the chamber assembly, and a second longitudinal spacing member located towards the second longitudinal end of the chamber assembly, the second longitudinal spacing member extending away from the outer surface of the chamber assembly, the first and second longitudinal spacing members configured to form a fluid passageway for a first heat exchange medium on the exterior surface of the chamber assembly.

14. The heat exchanger of claim 12, wherein the chamber assembly further comprises a first longitudinal spacing member located towards the first longitudinal end of the chamber assembly, the first longitudinal spacing member extending away from the outer surface of the chamber assembly, and a second longitudinal spacing member located towards the second longitudinal end of the chamber assembly, the second longitudinal spacing member extending away from the outer surface of the chamber assembly, the first and second longitudinal spacing members configured to form a fluid passageway for a first heat exchange medium on the exterior surface of the chamber assembly.

15. The heat exchanger of claim 9, wherein the medium directing assembly further comprises an upper mating panel member in the form of a planar panel member, engaging the second longitudinal end of the first medium directing panel member and the chamber assembly, and a lower mating panel member in the form of a separate planar panel member, engaging the second longitudinal end of the second medium directing panel member and the chamber assembly.

16. The heat exchanger of claim 15, further comprising a distribution support member in the form of a planar panel member, having a first planar side and a second planar side, the second planar side generally on the opposite side from the first planar side, having a first vertical edge engaging the upper mating panel member, a second vertical edge engaging the lower mating panel member, a first longitudinal edge facing the chamber inlet, and a second longitudinal edge facing the chamber outlet.

17. A heat exchanger assembly comprising:

a plurality of longitudinally extending chamber assemblies, each chamber assembly comprising a plurality of panel members defining a respective hollow chamber within, each chamber assembly coupled together thereby defining a core of the heat exchanger assembly, the core configured to contain a first heat exchange medium within;

a first tank coupled to the core, defining a first vertical side of the heat exchanger assembly;

a second tank coupled to the core, defining a second vertical side of the heat exchanger assembly;

a first core lateral wall in the form of a planar panel member having a thickness, coupled to the core, defining a first lateral side of the heat exchanger assembly;

a second core lateral wall in the form of a planar panel member having a thickness, coupled to the core, defining a second lateral side of the heat exchanger assembly;

a first longitudinal end of each of the plurality of chamber assemblies together defining a first longitudinal surface of the heat exchanger assembly; and a second longitudinal end each of the plurality of chamber assemblies together defining a second longitudinal surface of the heat exchanger assembly, each chamber assembly provided with a chamber inlet configured to introduce a second heat exchange medium into the chamber, flowing in an initial line of flow, each chamber assembly provided with a chamber outlet configured to discharge the second heat exchange medium from the chamber, and a medium directing assembly provided within each chamber, each of the medium directing assemblies including:

a first medium directing panel member; and a second medium directing panel member, the first medium directing panel member and the second medium directing panel member are each a generally planar panel member having a first planar surface oriented at an angle relative to the longitudinal axial orientation established by the chamber assembly, facing the chamber inlet, the first medium directing panel member and the second medium directing panel member, each having a second planar surface oriented at an angle relative to the longitudinal axial orientation established by the chamber assembly, facing the chamber outlet, on the opposite side from the respective first planar surface, the first medium directing panel member located vertically above the second medium directing panel member, the first medium directing panel member and the second medium directing panel member each having a first longitudinal end disposed towards the chamber inlet, and each having a second longitudinal end disposed towards the chamber outlet, the first medium directing panel member and the second medium directing panel member each having the first longitudinal end positioned spaced apart from the chamber assembly and positioned towards the central axis of the chamber, and having the second longitudinal end positioned in closer proximity to the chamber assembly and positioned away from the central axis of the chamber, the first longitudinal end respectively of the first medium directing panel member and the second medium directing panel member having a width greater than a width of the remainder longitudinal span of the respective medium directing panel member, the first planar surface respectively of the first medium directing panel member and the second medium directing panel member configured to cause the second heat exchange medium introduced into the chamber flowing in the initial line of flow to divert into two divergent vertical flows, the second heat exchange medium directed towards the first planar surface of the first medium directing panel member further diverted into two divergent lateral flows, the two divergent lateral flows comprising a first flow generally flowing in a longitudinally extending arcuate manner cresting around a first lateral edge of the first medium directing panel member, and a second flow generally flowing in a longitudinally extending arcuate manner cresting around a second lateral edge of the first medium directing panel member, the second heat exchange medium directed towards the first planar surface of the second medium directing panel member further diverted into two divergent lateral flows, a first flow generally flowing in a longitudinally extending arcuate manner cresting around a first lateral edge of the second medium directing panel member, and a second flow generally flowing in a longitudinally extending arcuate manner cresting around a second lateral edge of the second medium directing panel member, the second heat exchange medium diverted into the two divergent lateral flows around the first lateral edge and the second lateral edge of the first medium directing panel member are caused to collide into each other on the second planar surface side of the first medium directing panel member, the second heat exchange medium diverted into the two divergent lateral flows around the first lateral edge and the second lateral edge of the second medium directing panel member are caused to collide into each other on the second planar surface side of the second medium directing panel member, and the second heat exchange medium diverted from the initial line of flow by the medium directing assembly converges into a singular flow stream within the chamber within the chamber assembly, the singular flow stream flowing conforming to the initial line of flow, prior to being discharged from the chamber outlet.

18. The heat exchanger assembly of claim 17, wherein the first longitudinal end of the first medium directing panel member engages the first longitudinal end of the second medium directing panel member.

19. The heat exchanger assembly of claim 17, wherein the first lateral edge of the first medium directing panel member, the second lateral edge of the first medium directing panel member, the first lateral edge of the second medium directing panel member, and the second lateral edge of the second medium directing panel member are each set at an acute angle relative to the plane established by the laterally adjacent surface of the chamber body from each respective lateral edge of the first and the second medium directing panel member.

20. The heat exchanger assembly of claim 17, wherein the first longitudinal end respectively of the first medium directing panel member and the second medium directing panel member extend to the first longitudinal end of the chamber body, while the second longitudinal end respectively of the first medium directing panel member and the second medium directing panel member engages the chamber assembly.

* * * * *